US009583053B2

(12) United States Patent
Teranishi

(10) Patent No.: US 9,583,053 B2
(45) Date of Patent: Feb. 28, 2017

(54) LIQUID CRYSTAL DISPLAY DEVICE, DRIVING METHOD OF LIQUID CRYSTAL DISPLAY DEVICE AND ELECTRONIC APPARATUS, HAVING PIXELS WITH MEMORY FUNCTIONS

(71) Applicant: Japan Display Inc., Tokyo (JP)

(72) Inventor: Yasuyuki Teranishi, Kanagawa (JP)

(73) Assignee: Japan Display Inc., Tokyo (JP)

( * ) Notice: Subject to any disclaimer, the term of this patent is extended or adjusted under 35 U.S.C. 154(b) by 359 days.

(21) Appl. No.: 13/744,083

(22) Filed: Jan. 17, 2013

(65) Prior Publication Data

US 2013/0241974 A1 Sep. 19, 2013

(30) Foreign Application Priority Data

Mar. 15, 2012 (JP) ..... 2012-058356

(51) Int. Cl.
*G09G 3/36* (2006.01)
*G09G 3/20* (2006.01)

(52) U.S. Cl.
CPC ..... *G09G 3/3607* (2013.01); *G09G 3/207* (2013.01); *G09G 3/2081* (2013.01);
(Continued)

(58) Field of Classification Search
CPC ..... G09G 2300/0842; G09G 2300/0857
(Continued)

(56) References Cited

U.S. PATENT DOCUMENTS 7,002,537 B1 * 2/2006 Ito ..... G09G 3/3659 315/169.3
8,242,997 B2 * 8/2012 Lee et al. ..... 345/92
(Continued)

FOREIGN PATENT DOCUMENTS

CN 101241282 8/2008
CN 101317211 12/2008
(Continued)

OTHER PUBLICATIONS

Taiwanese Office Action and Search Report issued Aug. 15, 2014, for corresponding Taiwanese Appln. No. 101141630.
(Continued)

*Primary Examiner* — Chanh Nguyen
*Assistant Examiner* — Yuzhen Shen
(74) *Attorney, Agent, or Firm* — K&L Gates LLP

(57) ABSTRACT

A liquid crystal display device in which pixels having a memory function are arranged includes: a display drive unit performing display driving by a driving method for obtaining halftone gray scales by setting plural frames as one cycle and temporarily changing gray scales of respective pixels within one cycle; and a pixel drive unit supplying a voltage having the same phase as, or the reverse phase to, a common voltage the polarity of which is inverted in a given cycle and applied to counter electrodes of liquid crystal capacitors to pixel electrodes of the liquid crystal capacitors. The pixel drive unit supplies an intermediate voltage between high- and low-voltage sides of the common voltage to the pixel electrodes of the liquid crystal capacitors at the time of transition from the supply of the voltage having the same phase to the supply of the voltage having reverse phase.

9 Claims, 16 Drawing Sheets

(52) U.S. Cl.
CPC ... *G09G 3/3648* (2013.01); *G09G 2300/0842* (2013.01); *G09G 2300/0857* (2013.01)

(58) Field of Classification Search
USPC ..... 345/98, 101, 204
See application file for complete search history.

(56) References Cited

U.S. PATENT DOCUMENTS

| | | | | |
|---|---|---|---|---|
| 8,816,999 | B2 * | 8/2014 | Dallas et al. | 345/205 |
| 8,830,436 | B2 * | 9/2014 | Tamaki et al. | 349/144 |
| 8,884,996 | B2 * | 11/2014 | Teranishi et al. | 345/690 |
| 2004/0013427 | A1 * | 1/2004 | Ito | G09G 3/3659 398/42 |
| 2004/0036968 | A1 * | 2/2004 | Ito | G03B 21/16 359/443 |
| 2008/0191989 | A1 | 8/2008 | Lee | |
| 2009/0091579 | A1 * | 4/2009 | Teranishi et al. | 345/530 |
| 2009/0102751 | A1 | 4/2009 | Takatoku | |
| 2011/0227887 | A1 | 9/2011 | Dallas et al. | |

FOREIGN PATENT DOCUMENTS

| | | | | |
|---|---|---|---|---|
| JP | 2001-125528 | | 5/2001 | |
| JP | 2005173387 | | 6/2005 | |
| JP | 2010266780 | | 11/2010 | |
| JP | 2010266780 | A * | 11/2010 | G09G 3/36 |
| JP | 2010-277461 | | 12/2010 | |
| JP | 2010286846 | | 12/2010 | |
| JP | 2011242460 | | 12/2011 | |
| TW | 200939456 | | 9/2009 | |

OTHER PUBLICATIONS

Notice of Rejection issued in connection with Japanese Patent Application No. 2012-058356, dated Jun. 30, 2015. (6 pages).
Office Action issued in Chinese patent application No. 201310039158.5, mailed Jan. 25, 2016 (20 pages).
Japanese Office Action mailed Feb. 3, 2015, for corresponding Japanese Appln. No. 2012-058356.

* cited by examiner

2-BIT AREA COVERAGE MODULATION + 1-BIT FRC DRIVING

2-BIT AREA COVERAGE MODULATION

LIQUID CRYSTAL DISPLAY DEVICE, DRIVING METHOD OF LIQUID CRYSTAL DISPLAY DEVICE AND ELECTRONIC APPARATUS, HAVING PIXELS WITH MEMORY FUNCTIONS

CROSS REFERENCES TO RELATED APPLICATIONS

The present application claims priority to Japanese Priority Patent Application JP 2012-058356 filed in the Japan Patent Office on Mar. 15, 2012, the entire content of which is hereby incorporated by reference.

BACKGROUND

The present disclosure relates to a liquid crystal display device, a driving method of the liquid crystal display and an electronic apparatus.

As one of techniques for increasing the number of gray scales which can be displayed (expressed) in a display device, a driving method for obtaining halftone gray scales by setting plural frames as one cycle and temporarily changing gray scales of respective pixels within one cycle is known (for example, refer to JP-A-2007-147932 (Patent Document 1). Here, to setting plural frames as one cycle means to divide image generation of one frame into plural sub-frames (a so-called time division driving method).

The driving method, namely, the time division driving method is also called a FRC (Frame Rate Control) driving. The FRC driving is a driving method utilizing residual image characteristics (residual image effect) of human eyes by switching luminance of different plural gray scales in units to sub-frames at high speed to thereby display luminance of halftone gray scales in luminance of plural gray scales, which can increase the number of gray scales as compared with the case of normal driving in which one frame is set as one cycle.

SUMMARY

Incidentally, when the FRC driving is used for increasing the number of gray scales, response speed at transition from white (liquid crystal OFF) to black (liquid crystal ON) is different from response speed at transition from black to white in normally white liquid crystal under the characteristics of liquid crystal in a liquid crystal display device. When the response speed differs between liquid crystal ON and OFF as described above, it is difficult to display a desired halftone gray scale in the case of applying the FRC driving.

In view of the above, it is desirable to provide a liquid crystal display device, a driving method of the a liquid crystal display and an electronic apparatus capable of realizing display the desired halftone gray scale when applying the FRC driving.

An embodiment of the present disclosure is directed to a liquid crystal display device in which pixels having a memory function are arranged and which includes a display drive unit performing display driving by a driving method for obtaining halftone gray scales by setting plural frames as one cycle and temporarily changing gray scales of respective pixels within one cycle, and a pixel drive unit supplying a voltage having the same phase as, or a voltage having a reverse phase to a common voltage the polarity of which is inverted in a given cycle and applied to counter electrodes of liquid crystal capacitors to pixel electrodes of the liquid crystal capacitors, in which the pixel drive unit supplies an intermediate voltage between a high-voltage side and a low-voltage side of the common voltage to the pixel electrodes of the liquid crystal capacitors at the time of transition from the supply of the voltage having the same phase to the supply of the voltage having reverse phase. The liquid crystal display device according to the embodiment of the present disclosure is preferably used as a display unit in various types of electronic apparatuses.

Another embodiment of the present disclosure is directed to a drive method to be used when driving a liquid crystal display device in which pixels having a memory function are arranged and which includes a display drive unit performing display driving by a driving method for obtaining halftone gray scales by setting plural frames as one cycle and temporarily changing gray scales of respective pixels within one cycle, in which a voltage having the same phase as, or a voltage having a reverse phase to a common voltage the polarity of which is inverted in a given cycle and applied to counter electrodes of liquid crystal capacitors is supplied to pixel electrodes of the liquid crystal capacitors, the method including supplying an intermediate voltage between a high-voltage side and a low-voltage side of the common voltage to the pixel electrodes of the liquid crystal capacitors at the time of transition from supply of the voltage of the same phase to the supply of the voltage having reverse phase.

In the liquid crystal display in which pixels having the memory function are arranged, the intermediate voltage between the high-voltage side and the low-voltage side of the common voltage is interposed (sandwiched) at the time of transition from the supply of the voltage having the same phase as the common voltage to the supply of the voltage having the reverse phase when applying the FRC driving. That is, the voltage having the reverse phase to the common electrode makes a transition in stages so that the voltage in the same phase→the intermediate voltage→the voltage in the reverse phase. Accordingly, as response speed at the time of liquid crystal ON becomes slow, the difference of response speed between liquid crystal ON/OFF can be reduced as compared with a case where the intermediate voltage is not interposed, namely, the case where transition is made directly from the voltage in the same phase to the voltage in the reverse phase.

According to the embodiments of the present disclosure, the intermediate voltage is interposed at the time of transition from the supply of the voltage having the same phase as the common voltage to the voltage having the reverse phase, thereby reducing the difference of response speed between liquid crystal ON/OFF as compared with the case where the intermediate voltage is not interposed, as a result, a desirable halftone gray scale can be displayed.

Additional features and advantages are described herein, and will be apparent from the following Detailed Description and the figures.

DETAILED DESCRIPTION

Figure 1:
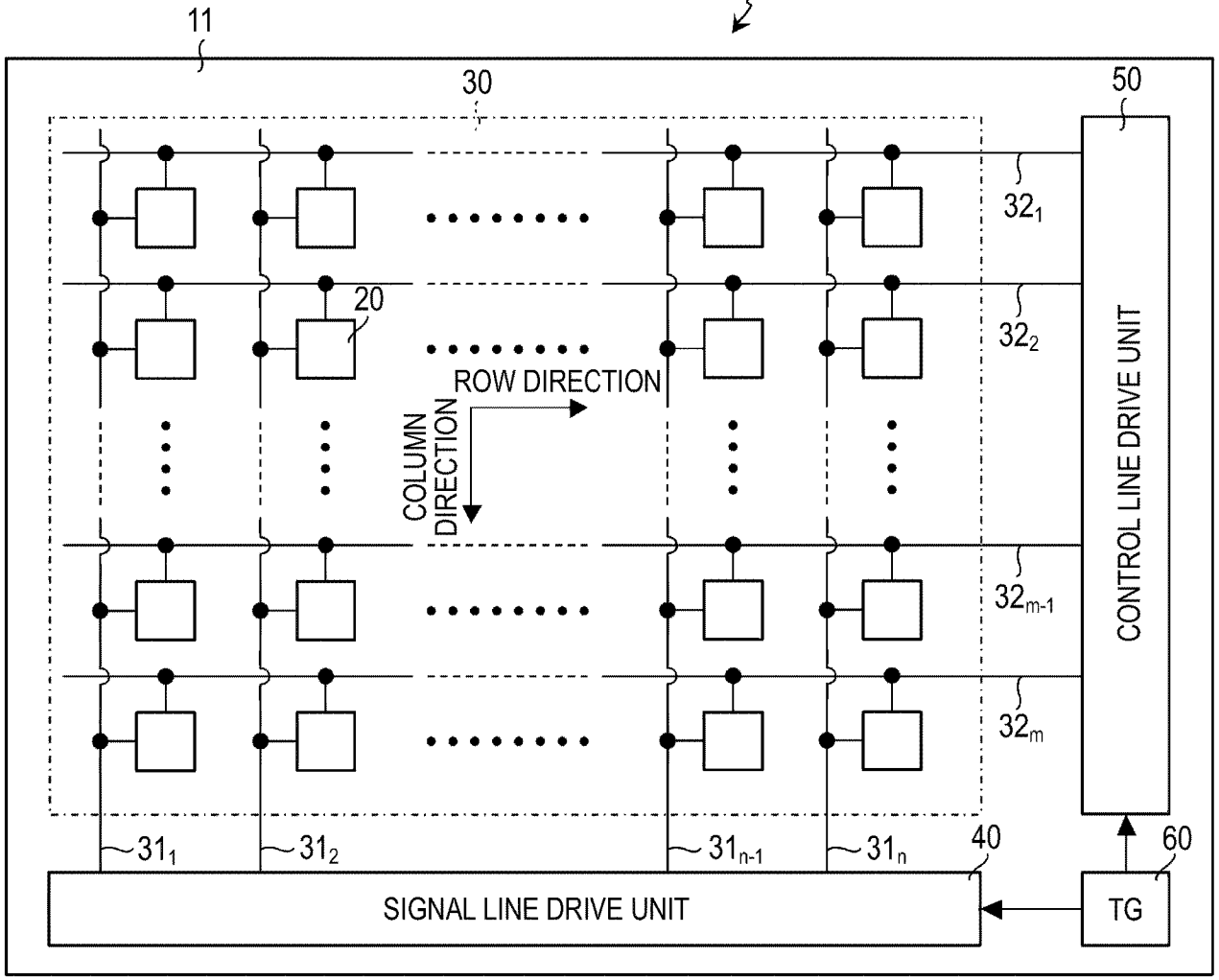
FIG. 1 is a system configuration diagram showing an outline of a configuration of an active-matrix liquid crystal display device according to an embodiment of the present disclosure.

Hereinafter, modes for carrying out the present disclosure (hereinafter referred to as an embodiment) will be explained in detail with reference to the drawings. The present disclosure is not limited to the embodiment and various numeric values in the embodiment are shown as examples. In the following description, the same symbols are used for components having the same features or the same functions and repeated explanation is omitted. The explanation will be made in the following order.

1. Explanation Throughout Liquid Crystal Display Device, Driving Method of Liquid Crystal Display Device and Electronic Apparatus According to Embodiment of Present Disclosure
2. Liquid Crystal Display Device According to Embodiment
   - 2-1. System Configuration
   - 2-2. MIP-type Pixels
   - 2-3. Area Coverage Modulation Method
   - 2-4. Characteristics of Embodiment
3. Electronic Apparatus
4. Configuration of Present Disclosure <1. Explanation Throughout Liquid Crystal Display Device, Driving Method of Liquid Crystal Display Device and Electronic Apparatus According to Embodiment of Present Disclosure>

A liquid crystal display according to an embodiment of the present disclosure is a liquid crystal display device in which pixels having a memory function are arranged. As this kind of liquid crystal display, for example, a so-called MIP (Memory In Pixel)-type liquid crystal display device including a memory unit capable of storing data in a pixel can be cited as an example. The liquid crystal display device having the memory function in pixels can be realized by using liquid crystal with memory properties for pixels. The liquid crystal display device according to the embodiment of the present disclosure may be a liquid crystal display device supporting monochrome display or a liquid crystal display device supporting color display.

The liquid crystal display device having the memory function in pixels can realize display in an analog display mode and display in a memory display mode by a mode changeover switch as the device can store data in pixels. Here, the "analog display mode" is a display mode of displaying gray scales of pixels in an analog manner. The "memory display mode" is a display mode of displaying gray scales of pixels in a digital manner based on binary data (logic "1"/logic "0") stored in pixels.

In the liquid crystal display device having the memory function in pixels, for example, in the MIP-type liquid crystal display device, the number of gray scales to be displayed is liable to be reduced as a circuit scale built in each pixel is limited due to constraints in resolution. Accordingly, the MIP-type liquid crystal display device can apply a configuration of performing display driving by the FRC driving which obtains halftone gray scales by setting plural frames as one cycle, that is, dividing image generation of one frame into plural sub-frames and temporarily changing gray scales of respective pixels within one cycle (image generation cycle of one frame).

As described above, the "FRC driving" is a driving method utilizing residual image characteristics (residual image effect) of human eyes by switching luminance of different plural gray scales in units to sub-frames at high speed to thereby display luminance of halftone gray scales in luminance of plural gray scales. Here, the "sub-frame" represents each frame when setting plural frames as one cycle (image generation cycle of one frame). When applying the FRC driving, the number of gray scales which can be displayed (expressed) can be increased as compared with the case of the driving in units of frames in which one frame is set as one cycle (image generation cycle of one frame).

As described above, the liquid crystal display, the driving method of the liquid crystal display and the electronic apparatus according to the embodiment of the present disclosure are assumed to have a configuration in which pixels having the memory function are arranged and display driving is performed by the FRC driving. When driving pixels having the memory function, a voltage of the same phase as or a voltage of a reverse phase to a common voltage to be applied to counter electrodes of liquid crystal capacitors is applied (supplied) to pixel electrodes of the liquid crystal capacitors. The common voltage is a voltage in which the polarity is inverted in a given cycle.

In the liquid crystal display device, response speed is different at the transition from a liquid crystal ON-state to a liquid crystal OFF-state and at the transition from the liquid crystal OFF-state to the liquid crystal ON-state under the characteristics of liquid crystal. The liquid crystal is not particularly limited, and normally white liquid crystal or normally black liquid crystal may be used. Here, explanation will be made by citing the normally white liquid crystal as an example, however, the normally black liquid crystal has opposite characteristics to the normally white liquid crystal.

In the case of the normally white liquid crystal, a state in which the voltage is not applied to liquid crystal is the liquid crystal OFF-state, which will be white display. On the other hand, a state in which the voltage is applied to the liquid crystal is the liquid crystal ON-state, which will be black display. In the normally white liquid crystal, the response speed at the transition from while (liquid crystal OFF) to black (liquid crystal ON) is different from response speed from black to white.

Specifically, the response speed at the transition from the liquid crystal OFF to the liquid crystal ON is faster than the response speed at the transition from the liquid crystal ON to the liquid crystal OFF. When the FRC driving is applied in the case where the response speed differs at the time of liquid crystal ON/OFF as described above, the halftone gray scale comes close to black, therefore, it is difficult to display a desired halftone gray scale.

Accordingly, in the liquid crystal display device, the driving method of the liquid crystal display device and the electronic apparatus according to the embodiment of the present disclosure, an intermediate voltage between a high-voltage side and a low-voltage side of the common voltage is supplied to the pixel electrodes of the liquid crystal capacitors when the supply of the same voltage is made to be transited to the supply of the reverse phase voltage with respect to the common voltage.

The intermediate voltage is interposed at the time of transition from the supply of the same phase voltage to the supply of the reverse phase voltage when applying the FRC driving, thereby reducing the difference of response speed at the time of liquid crystal ON/OFF as compared with the case in which the intermediate voltage is not interposed. Accordingly, the phenomenon such that the halftone gray scale comes close to black can be avoided in the case of, for example, the normally while liquid crystal, as a result, the desired halftone gray scale can be realized.

In the liquid crystal display device, the driving method of the liquid crystal display device and the electronic apparatus including the above preferable configuration, the timing of supplying the intermediate voltage between the high-voltage side and the low-voltage side of the common voltage can be controlled so as to correspond to lines (pixel rows) to which display driving is performed. At this time, it is preferable that the intermediate voltage is supplied in accordance with the timing of rewriting memory contents of pixels.

In the liquid crystal display device, the driving method of the liquid crystal display device and the electronic apparatus including the above preferable configuration, the supply of the intermediate voltage can be controlled in accordance with the temperature of peripheral environment of the liquid crystal display device (liquid crystal display panel).

Response characteristics of liquid crystal vary according to the temperature of peripheral environment. Specifically, the response speed of liquid crystal becomes faster under environment of a high-temperature state in which the temperature of peripheral environment exceeds a given temperature. Accordingly, the response speed of liquid crystal at the transition from the liquid crystal ON to the liquid crystal OFF becomes faster, for example, in the normally white liquid crystal.

From the viewpoint of the above, it is preferable that the supply of the intermediate voltage is not performed when the temperature of peripheral environment exceeds a given temperature and also preferable that the supply of the intermediate voltage is performed when the temperature of peripheral environment is equal to or lower than the given temperature. At this time, the configuration in which a voltage value of the intermediate voltage is controlled in accordance with the temperature of peripheral environment, or in which a period of supplying the intermediate voltage is controlled in accordance with the temperature of peripheral environment can be realized.

In the MIP-type liquid crystal display device, only two gray scales can be expressed by one bit in each pixel. Accordingly, it is preferable to apply an area coverage modulation method in which one pixel includes plural sub-pixels and gray scales are displayed by combination of electrode areas of the plural sub-pixels as a gray scale expression method in driving pixels.

Here, the "area coverage modulation" method is the gray scale expression method in which $2^N$-gray scales are expressed by weighting N-sub-pixel electrodes so that the area ratio will be $2^0, 2^1, 2^2, \ldots, 2^{N-1}$. The area coverage modulation method is applied for the purpose of improving nonuniformity in image quality, for example, due to variations in characteristics of TFTs (Thin Film Transistors) included in pixel circuits.

It is preferable that the pixel electrode of the pixel driven by the area coverage modulation method is divided into plural electrodes in units of plural sub-pixels and that gray scale display is performed by combination of areas of plural electrode. In this case, it is preferable that plural electrodes include three electrodes, and gray scale display is performed by combination of areas of a central electrode and two electrodes sandwiching the central electrode. It is also preferable that two electrodes sandwiching the center electrode are electrically connected to each other and are driven by one drive circuit.

<2. Liquid Crystal Display Device According to Embodiment>

Subsequently, an active-matrix liquid crystal display device as the liquid crystal display device according to the embodiment of the present disclosure will be explained.

[2-1. System Configuration]

FIG. 1 is a system configuration diagram showing an outline of a configuration of an active-matrix liquid crystal display device according to the embodiment of the present disclosure. The liquid crystal display device has a panel structure in which two substrates (not shown) at least one substrate of which is transparent are arranged opposite to each other with a given gap and liquid crystal is sealed between these two substrates.

A liquid crystal display device 10 according to the embodiment includes a pixel array unit 30 in which plural pixels 20 including liquid crystal capacitors are two-dimensionally arranged in a matrix state and a display device unit arranged on the periphery of the pixel array unit 30. The display drive unit includes a signal line drive unit 40, a control line drive unit 50, a drive timing generator 60 and so on, which are integrated on, for example, a liquid crystal display panel (substrate) 11 which is the same panel on which the pixel array pixel 30 is arranged, driving respective pixels 20 of the pixel array unit 30.

In the case that the liquid crystal display device 10 supports color display, one pixel includes plural sub-pixels, and respective sub-pixels respectively correspond to pixels 20. More specifically, in the liquid crystal display device for color display, one pixel includes a sub-pixel of red (R) light, a sub-pixel of green (G) light and a sub-pixel of blue (B) light.

One pixel is not limited to combination of three primary colors of RGB, and it is possible to add the sub-pixel of one color or sub-pixels of plural colors are further added to the sub-pixels of three primary colors to thereby form one pixel. More specifically, for example, it is possible to add a sub-pixel of white light to form one pixel for improving luminance, or it is possible to add at least one sub-pixel of complementary color to form one pixel for expanding color reproduction range.

The liquid crystal display device 10 according to the embodiment of the present disclosure uses pixels having the memory function, for example, MIP-type pixels having memory units capable of storing data in respective pixels, capable of supporting display both in the analog display mode and the memory display mode. In the liquid crystal display device 10 using the MIP-type pixels, a fixed voltage is constantly applied to the pixels 20, therefore, there is an advantage that a shading problem due to voltage variations with time caused by leakage of light in pixel transistors can be solved.

In FIG. 1, signal lines $\mathbf{31}_1$ to $\mathbf{31}_n$ (hereinafter may be also written as merely "signal lines 31") are arranged in respective pixel columns along a column direction with respect to m-row×n-column pixel arrangement of the pixel array unit 30. Control lines $\mathbf{32}_1$ to $\mathbf{32}_m$ (hereinafter may be also written as merely "control lines 32") are arranged in respective pixel rows along a row direction. Here, the "column direction" indicates the arrangement direction of pixels in the pixel columns (namely, the "vertical direction") and the "row direction" indicates the arrangement direction of pixels in the pixel rows (namely, the "horizontal direction").

Respective terminals of the signal lines 31 ($\mathbf{31}_1$ to $\mathbf{31}_n$) are connected to respective output terminals corresponding to the pixel columns of the signal line drive unit 40. The signal line drive unit 40 operates so as to output signal potentials reflecting arbitrary gray scales (analog potentials in the analog display mode, binary potentials in the memory display mode) to corresponding signal lines 31. The signal line drive unit 40 operates so as to output signal potentials reflecting necessary gray scales to the corresponding signal lines 31 when logic levels of the signal potentials to be held in the pixel 20 are replaced even in the case of, for example, the memory display mode.

Though each of the control lines $\mathbf{32}_1$ to $\mathbf{32}_m$ is shown as one wiring line, the line is not limited to one wiring line. Actually, each of the control lines $\mathbf{32}_1$ to $\mathbf{32}_m$ includes plural wiring lines. Respective terminals of the control lines $\mathbf{32}_1$ to $\mathbf{32}_m$ are connected to respective output terminals corresponding to pixel rows of the control line drive unit 50. The control line drive unit 50 performs control of writing operation of signal potentials reflecting gray scales with respect to pixels 20, which are outputted to the signal lines $\mathbf{31}_1$ to $\mathbf{31}_n$ from the signal line drive unit 40, for example, in the analog display mode.

The drive timing generator (TG) 60 generates various driving pulses (timing signals) for driving the signal line drive unit 40 and the control line drive unit 50, and supplies the signals to these drive units 40 and 50.

[2-2. MIP-type Pixel]

Subsequently, MIP-type pixels used as the pixels 20 will be explained. The MIP-type pixels can support both the display in the analog display mode and the display in the memory display mode. As described above, the analog display mode is the display mode of displaying gray scales of pixels in the analog manner. The memory display mode is the display mode of displaying gray scales of pixels in the digital manner based on binary information (logic "1"/logic "0") stored in memories of pixels.

In the memory display mode, it is not necessary to execute writing operation of signal potentials reflecting gray scales in a frame period as information held in the memory unit is used. Accordingly, power consumption can be reduced in the memory display mode as compared with the case of the analog display mode in which writing operation of signal potentials reflecting gray scales has to be executed in the frame period. In other words, there is an advantage that the power consumption of the display device can be reduced.

Figure 2:
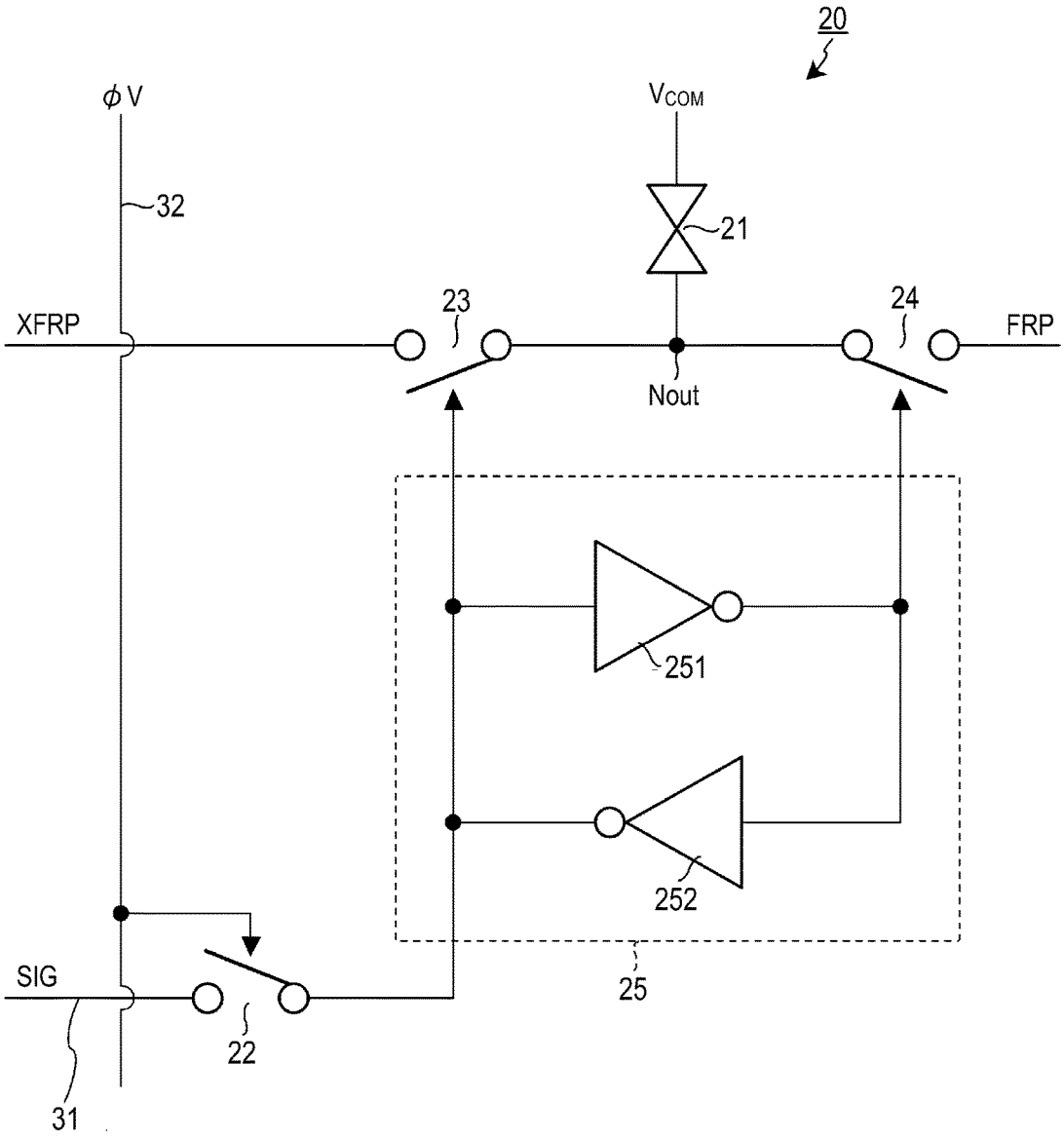
FIG. 2 is a block diagram showing an example of a circuit configuration of a MIP-type pixel.
Figure 3:
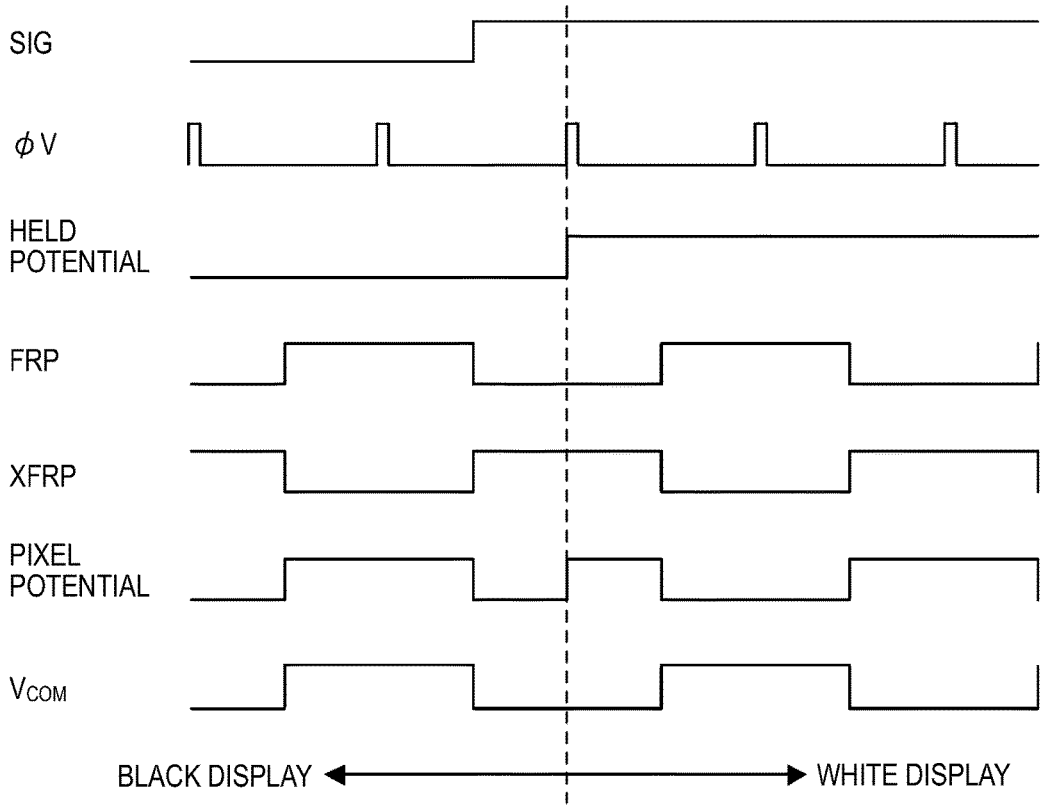
FIG. 3 is a timing chart used for explaining operation of the MIP-type pixel.

FIG. 2 is a block diagram showing an example of a circuit configuration of the MIP-type pixel 20. FIG. 3 shows a timing chart used for explaining operation of the MIP-type pixel 20.

The pixel 20 includes a pixel transistor made of, for example, a thin-film transistor (TFT) and a storage capacitor though not shown for simplifying the drawing, in addition to a liquid crystal capacitor 21. The liquid crystal capacitor 21 means a capacitor component of a liquid crystal material generated between the pixel electrode and a counter electrode formed opposite to the pixel electrode. A common voltage $V_{COM}$ is applied to the counter electrode of the liquid crystal capacitor 21, which is common to all pixels. As shown in the timing chart of FIG. 3, the common voltage $V_{COM}$ is a voltage in which the polarity is inverted in a given cycle (for example, in each frame period).

The pixel 20 is further configured to have a SRAM function including three switching devices 22 to 24 and a latch unit 25. One terminal of the switching device 22 is connected to the signal line 31 (corresponding to one of the signal lines $\mathbf{31}_1$ to $\mathbf{31}_n$ of FIG. 1). Then, when a scanning signal $\phi V$ is given from the signal line drive unit 50 of FIG. 1 through the control line 32 (corresponding to one of the control lines $\mathbf{32}_1$ to $\mathbf{32}_m$ of FIG. 1), the switch device 22 becomes ON (open)-state, taking data SIG supplied from the signal line drive unit 40 of FIG. 1 through the signal line 31. The control line 32 indicates a scanning line in this case The latch unit 25 includes inverters 251 and 252 connected to each other in parallel so as to face opposite directions, holding (latching) a potential corresponding to the data SIG taken by the switching device 22.

A voltage FRP having the same phase as the common voltage $V_{COM}$ and a voltage XFRP having the reverse phase to the common voltage $V_{COM}$ are applied to respective terminals on one sides of the switching devices 23 and 24. Respective terminals on the other sides of the switch devices 23 and 24 are connected in common, which is an output node $N_{OUT}$ of the present pixel circuit. Any one of the switching device 23 and 24 becomes ON-state in accordance with the polarity of the held potential of the latch unit 25. Accordingly, the voltage FRP having the same phase as the common voltage $V_{COM}$ or the voltage XFRP having the reverse phase to the common voltage $V_{COM}$ is applied to the pixel electrode of the liquid crystal capacitor 21 to which the common voltage $V_{COM}$ is applied at the counter electrode.

As apparent from FIG. 3, in a liquid crystal display panel of normally black (black display when no voltage is applied), the pixel potential of the liquid crystal capacitor 21 is in the same phase as the common voltage $V_{COM}$ when the held potential of the latch unit 25 has the negative polarity, therefore, the pixel displays black. The pixel potential of the liquid crystal capacitor 21 is in the reverse phase to the common voltage $V_{COM}$ when the held potential of the latch unit 25 has the positive polarity, therefore, the pixel displays white.

As apparent from the above, when any one of the switching devices 23 and 24 becomes ON-state in accordance with the polarity of the held potential of the latch unit 25 in the MIP-type pixel 20, the voltage FRP having the same phase or the voltage XFRP having the reverse phase is applied to the pixel electrode of the liquid crystal capacitor 21. Accordingly, a fixed voltage is constantly applied to the pixel 20, therefore, there is no danger that shading occurs.

Figure 4:
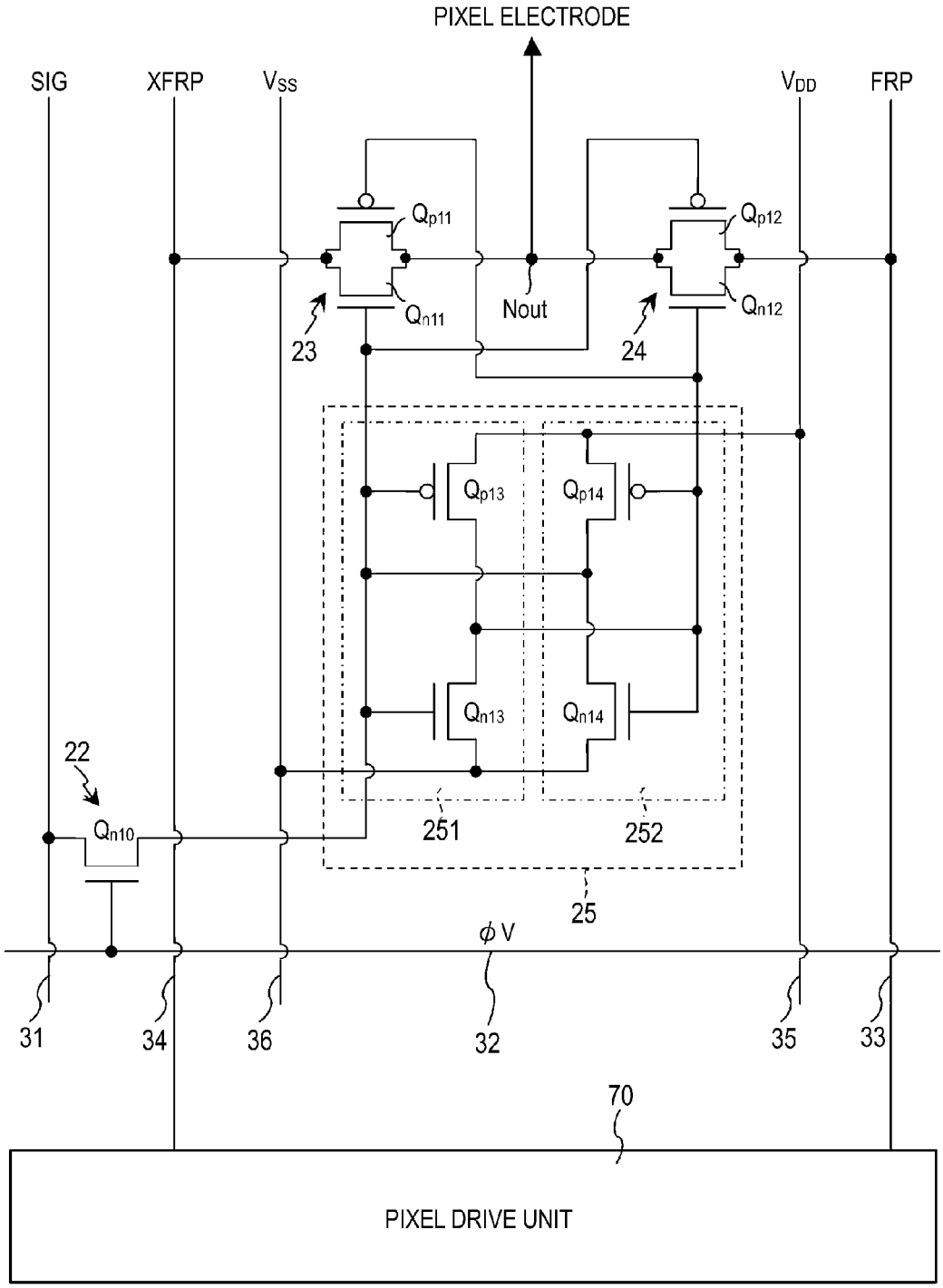
FIG. 4 is a circuit diagram showing an example of a specific circuit configuration of the MIP-type pixel.

FIG. 4 is a circuit diagram showing an example of a specific circuit configuration of the pixel 20, in which the same symbols are given to portions corresponding to FIG. 2 in the drawing.

In FIG. 4, the switching unit 22 is formed by, for example, an Nch-MOS transistor $Qn_{10}$. One of source/drain electrode of the Nch-MOS transistor $Qn_{10}$ is connected to the signal line 31 and a gate electrode is connected to the control line (scanning line) 32.

The switching devices 23 and 24 are both formed by a transfer switch in which, for example, the Nch-MOS transistor and a Pch-MOS transistor are connected in parallel. Specifically, the switching device 23 has a configuration in which an Nch-MOS transistor $Q_{n11}$ and a Pch-MOS transistor $Q_{p11}$ are connected in parallel. The switching device 24 has a configuration in which an Nch-MOS transistor $Q_{n12}$ and a Pch-MOS transistor $Q_{p12}$ are connected in parallel.

It is not always necessary that the switching devices 23 and 24 are the transfer switches in which the Nch-MOS transistor and the Pch-MOS transistor are connected in parallel. It is also possible to configure the switching devices 23 and 24 by using a single-conductive type MOS transistor, namely, the Nch-MOS transistor or the Pch-MOS transistor. The common connection node of the switching devices 23 and 24 is the output node $N_{OUT}$ of the present pixel circuit.

The inverters 251 and 252 are both formed by, for example, a CMOS inverter. Specifically, the inverter 251 has a configuration in which gate electrodes and drain electrodes of an Nch-MOS transistor $Q_{n13}$ and a Pch-MOS transistor $Q_{p13}$ are connected in common to each other. The inverter 252 has a configuration in which gate electrodes and drain electrodes of an Nch-MOS transistor $Q_{n14}$ and a Pch-MOS transistor $Q_{p14}$ are connected in common to each other.

The pixels 20 having the above circuit configuration in principle are arranged in matrix to be laid out in the row direction (horizontal direction) and in the column direction (vertical direction). In the matrix arrangement of the pixels 20, wiring lines 33 and 34 through which the voltages FRP and XFRP having the same phase as, and the reverse phase to the common voltage $V_{COM}$ are transmitted, and power supply lines 35 and 36 for a positive-side power supply voltage $V_{DD}$ and a negative-side power supply voltage $V_{SS}$ are arranged with respect to respective pixel columns, in addition to the signal lines 31 arranged with respect to respective pixel columns and the control lines 32 arranged with respect to respective pixel rows.

The voltage FRP and XFRP having the same phase as, and the reverse phase to the common voltage $V_{COM}$ are supplied to the pixel electrode of the liquid crystal capacitor 21 from the pixel drive unit 70 through the wiring lines 33 and 34 as well as the switching devices 23 and 24. The pixel drive unit 70 is one of components forming the above display drive unit. The pixel drive unit 70 appropriately sets an intermediate voltage between a high-voltage side and a low-voltage side of the common voltage $V_{COM}$ concerning the voltage XFRP having the reverse phase to the common voltage $V_{COM}$. The intermediate voltage corresponds to part of characteristics of the present embodiment, and the details thereof will be described later.

As described above, the active-matrix type liquid crystal display device 10 according to the embodiment has the configuration in which the pixels with the SRAM function (MIP) 20 each having the latch unit 25 storing the potential corresponding to the display data are arranged in matrix. In the embodiment, the example in which the SRAM is used as the memory unit built in the pixel 20 has been cited, however, the SRAM is just an example and memory units having other configurations, for example, a DRAM can be used.

The MIP-type liquid crystal display 10 can realize the display in the analog display mode and the display in the memory display mode by having the memory function (memory unit) in respective pixels 20 as described above. Then, as display is performed by using pixel data stored in the memory units in the case of the memory display mode, it is not necessary to execute the writing operation of signal potentials reflecting gray scales in the frame period constantly as the operation is executed singly, which leads to an advantage that power consumption of the liquid crystal display device 10 can be reduced.

There is a request that the display screen is desired to be partially rewritten, namely, the request that part of the display screen is desired to be rewritten. In this case, it is sufficient that the image data is partially written. When the display screen is partially rewritten, namely, when the image data is partially rewritten, it is not necessary to transfer data to pixels in which rewriting is not performed. Therefore, there is another advantage that power consumption can be further reduced in the liquid crystal display device 10 as the data transfer amount can be reduced.

[2-3. Area Coverage Modulation Method]

In the case of the display device having the memory function inside pixels, for example, the MIP-type liquid crystal display, only two gray scales can be expressed by one bit in each pixel 20. Accordingly, it is preferable that the liquid crystal display device 10 according to the embodiment uses the area coverage modulation method when applying the MIP-type device.

Specifically, the area coverage modulation method is applied, in which the pixel electrode to be the display area of the pixel 20 is divided into plural pixel (sub-pixel) electrodes on which weighting is performed according to areas. The pixel electrode can be a transparent electrode as well as a reflective electrode. The pixel potential selected in accordance with the held potential of the latch unit 25 is applied to the pixel electrodes on which weighting is performed according to areas, thereby displaying gray scales by combination of areas on which weighting is performed.

Here, specific explanation will be made by citing the area coverage modulation method in which four gray scales are expressed by two-bit by weighting areas (pixel areas) of pixel electrodes (sub-pixel electrodes) as 2:1 as an example for making understanding easier.

A structure of weighting the pixel areas as 2:1 is generally a structure in which the pixel electrode of the pixel 20 is divided into a sub-pixel electrode 201 with an area "1" and a sub-pixel electrode 202 with an area twice as the area of the sub-pixel electrode 201 (an area "2"). However, the center (barycenter) of each gray scale (display image) is not matched with (correspond to) the center (barycenter) of one pixel in the structure of FIG. 5A, which is not preferable in a point of gray scale expression.

Figure 5C:
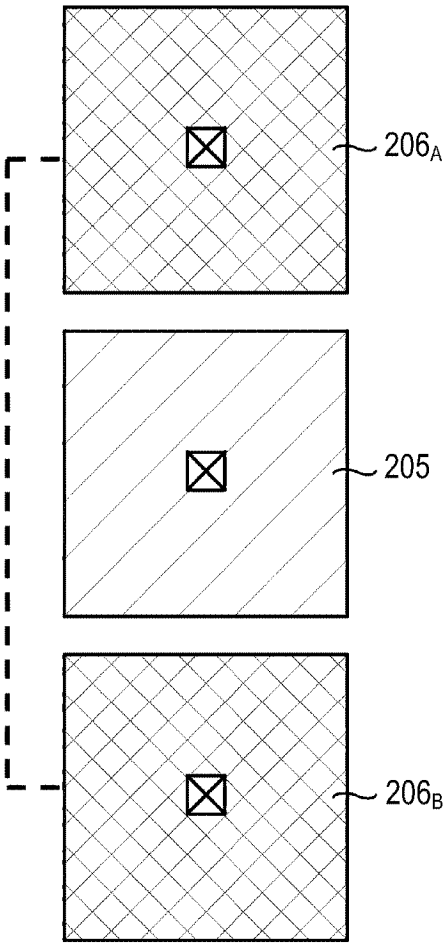
FIGS. 5A to 5C are explanatory views concerning pixel division in an area coverage modulation method.
Figure 5B:
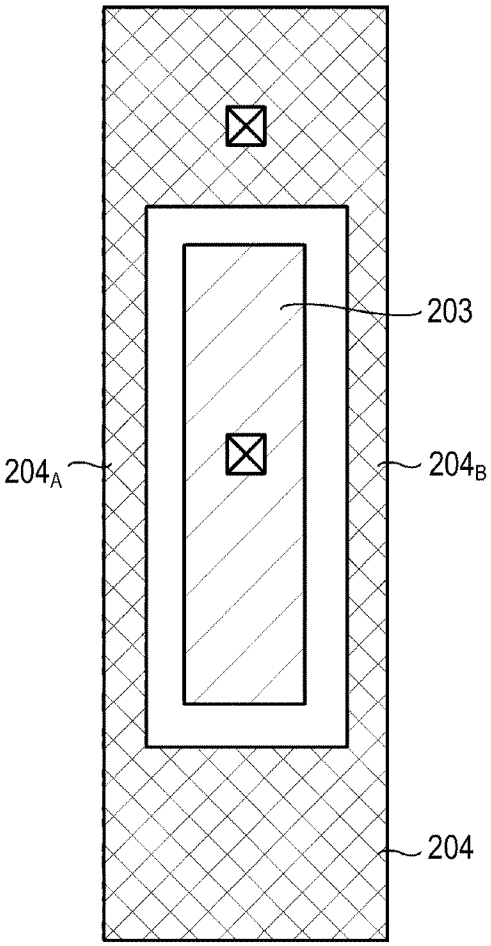

As a structure of matching the center of each gray scale with the center of one pixel, it is possible to consider a structure, as shown in FIG. 5B, in which the center of a sub-pixel electrode 204 with the area "2" is cut out, for example, in a rectangular shape, and a sub-pixel electrode 203 with the area "1" is arranged at the center of the rectangular area which has been cut out. However, in the case of the structure of FIG. 5B, as widths of connecting sections $\mathbf{204}_A$ and $\mathbf{204}_B$ of the sub-pixel electrode 204 positioned at both sides of the sub-pixel electrode 203 are narrow, the entire reflection area in the sub-pixel electrode 204 becomes small as well as alignment of liquid crystal in the vicinity of the connecting sections $204_A$ and $204_B$ will be difficult.

As described above, it is difficult to allow liquid crystal to be aligned in a good state as a state of the voltage to be applied to liquid crystal molecules varies according to the shape or size of the electrode in the case where a VA (Vertical Aligned) mode is taken in the area coverage modulation, in which liquid crystal molecules are aligned to be almost vertical to a substrate when the electric field is not applied. Additionally, as the area ratio of sub-pixel electrodes is not necessarily equal to the reflectance ratio, gradation design will be difficult. The reflectance ratio is determined by the area of sub-pixel electrode, liquid crystal alignment and so on. In the case of the structure of FIG. 5A, the ratio of lengths around the electrode is not 1:2 even when the area ratio is 1:2. Accordingly, the area ratio of sub-pixel electrodes is not necessarily equal to the reflectance ratio.

From the viewpoint of the above, it is preferable, in order to apply the area coverage modulation method, to apply a structure of so-called three-divided electrodes in which, for example, the pixel electrode is divided into three sub-pixel electrodes 205, $206_A$ and $206_B$ having the same area (size) as shown in FIG. 5C in consideration of expression of gray scales and effective use of the reflection area.

In the case of three-divided electrodes, the sub-pixel electrodes $206_A$ and $206_B$ positioned above and below so as to sandwich the sub-pixel electrode 205 at the center are paired, and two sub-pixel electrodes $206_A$ and $206_B$ as a pair are driven at the same time. In this case, the sub-pixel electrode 205 with the area "1" is connected to a low-order bit and the sub-pixel electrodes $206_A$ and $206_B$ with the area "2" are connected to a high-order bit. Accordingly, the pixel areas can be weighted as 2:1 between the two sub-pixel electrodes $206_A$ and $206_B$ and the sub-pixel electrode 205. As the sub-pixel electrodes $206_A$ and $206_B$ with the area "2" in the high-order bit is divided in half and arranged above and below so as to sandwich the sub-pixel electrode 205 at the center, thereby matching the center (barycenter) of each gray scale with the center (barycenter) of one pixel.

Figure 5A:
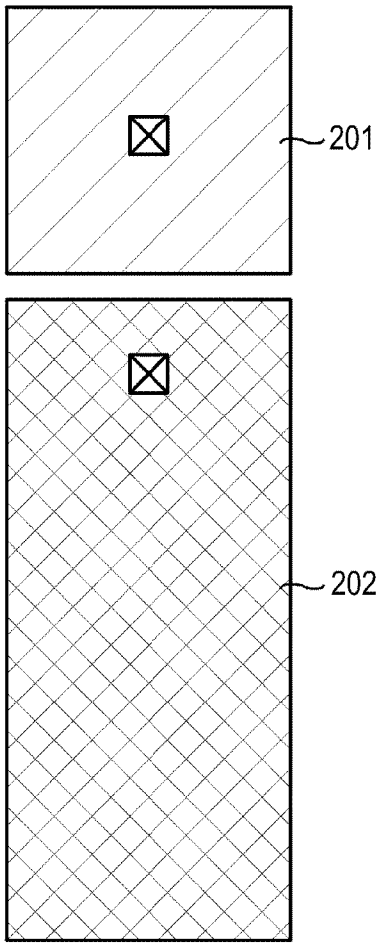

Here, when respective three sub-pixel electrodes 205, $206_A$ and $206_B$ electrically make contact with the drive circuit, the pixel size is increased as the number of contacts in metal wiring is increased as compared with the structures shown in FIGS. 5A and 5B, which will be a factor interrupting high-definition of the device. In particular, in the case of the MIP-type pixel configuration in which the memory unit is included in each pixel 20, there exist many circuit components and contact units such as transistors in one pixel 20 and there is no room in a layout area as apparent from FIG. 4, therefore, one contact unit largely affects the pixel size.

Figure 6:
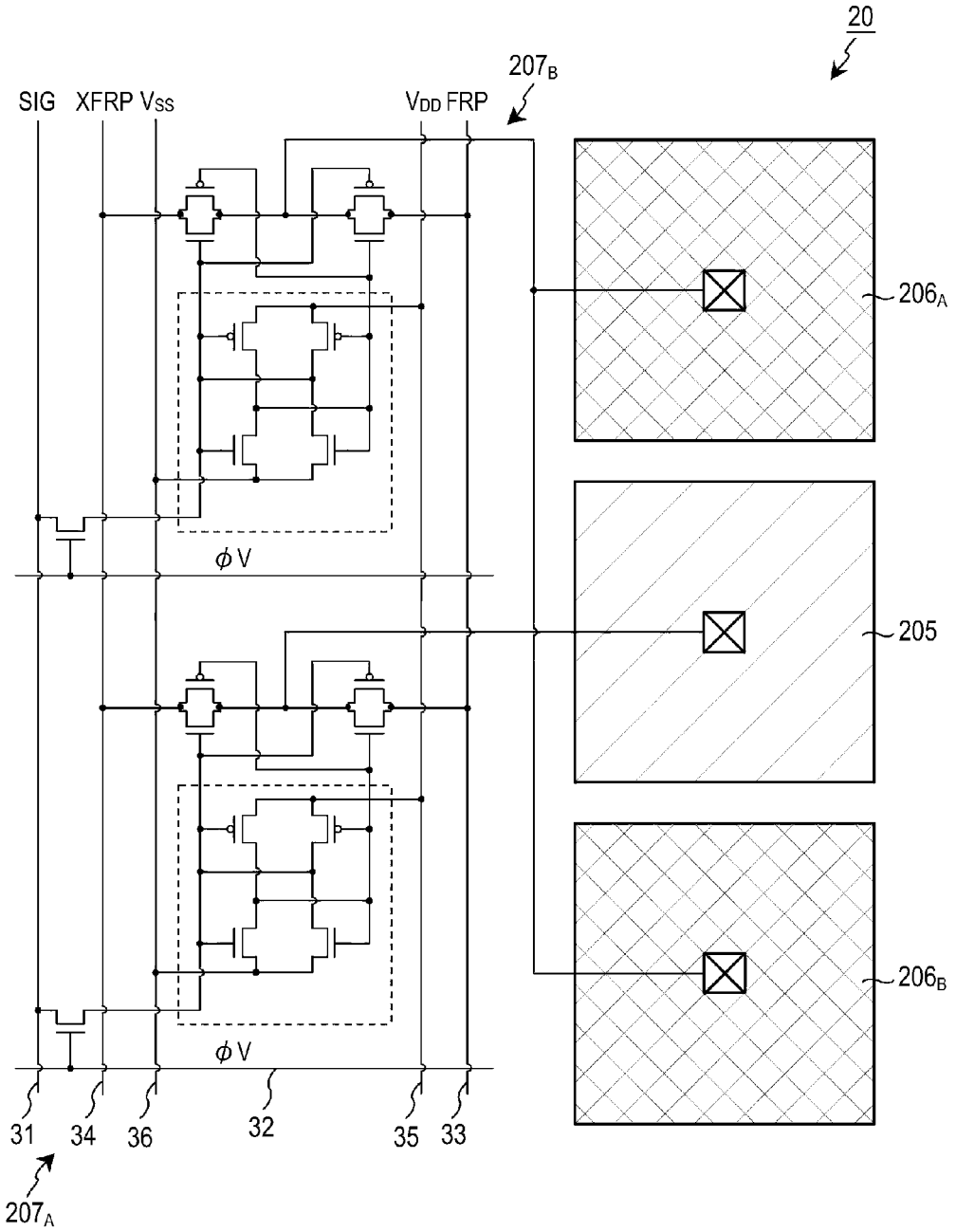
FIG. 6 is a circuit diagram showing correspondence between three sub-pixel electrodes and two-pairs of drive circuits in a configuration of three-divided electrodes.

In order to reduce the number of contacts, a pixel configuration in which two sub-pixel electrodes $206_A$ and $206_B$ which are apart from each other are electrically connected (wired) by sandwiching one sub-pixel electrode 205 may be applied. Then, as shown in FIG. 6, one drive circuit $207_A$ drives one sub-pixel electrode 205 and another drive pixel $207_B$ drives other two sub-pixel electrodes $206_A$ and $206_B$ at the same time. Here, the drive circuits $207_A$ and $207_B$ correspond to the pixel circuit shown in FIG. 4.

When the two sub-pixel electrodes $206_A$ and $206_B$ are driven by one drive circuit $207_B$ as described above, there is an advantage that the circuit configuration of the pixel 20 can be simplified as compared with the case of applying a configuration in which the two sub-pixel electrodes $206_A$ and $206_B$ are driven by different drive circuits.

Though the case in which the MIP-type pixel including the memory unit capable of storing data in each pixel is used as the pixel having the memory function has been cited as the example, the configuration is just an example. For example, a pixel using well-known memory liquid crystal can be cited as the pixel having the memory function in addition to the MIP-type pixel.

(Area Coverage Modulation+FRC Driving)

As the number of memories per each pixel to be integrated is limited because of constraints on the design rules in the MIP technique, the number of colors to be expressed is also limited. For example, in a display device of 180PPI (corresponding to 7-inch XGA), the limit of the number of memories to be integrated is 2-bit in respective colors of RGB, and the number of colors to be expressed is four gray scales for respective colors, namely, total 64 colors in normal driving using the area coverage modulation. In response to this, the FRC driving is adopted and the driving of area coverage modulation+FRC driving is performed, thereby increasing the number of gray scales to be expressed.

(2-bit Area Coverage Modulation+1-bit FRC Driving)

Figure 7B:
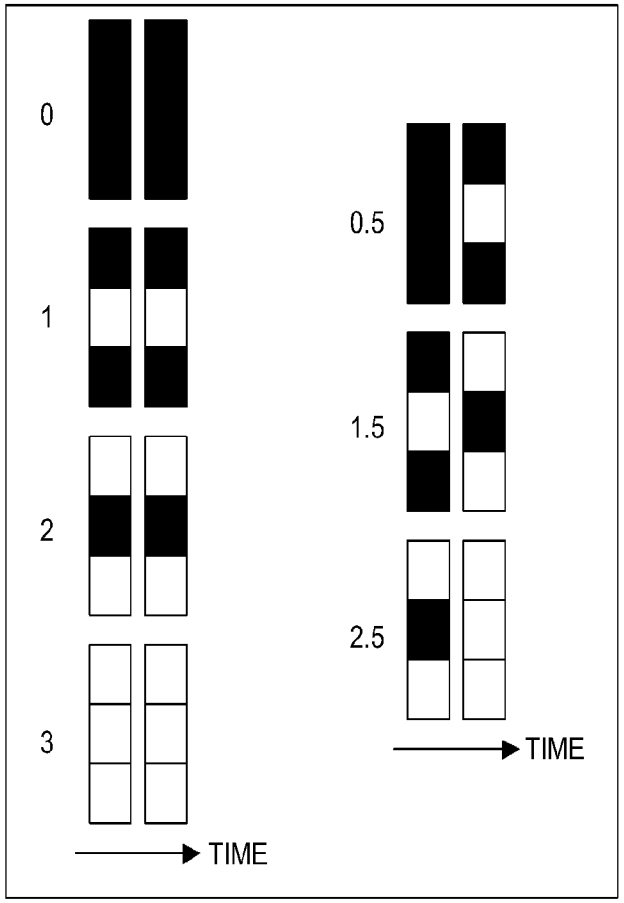
FIGS. 7A and 7B are explanatory diagrams showing a case of 2-bit area coverage modulation (FIG. 7A) and a case of 2-bit area coverage modulation+1-bit FRC driving (FIG. 7B)
Figure 7A:
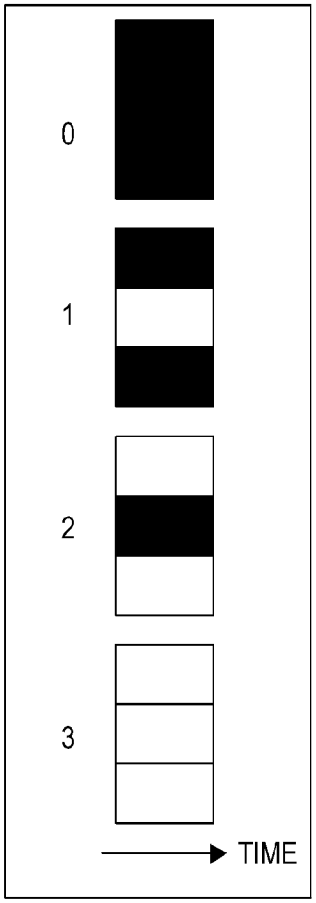

Here, the case of performing 1-bit FRC driving with respect to 2-bit area coverage modulation (area ratio=1:2) will be explained with reference to FIGS. 7A and 7B. In the case of 2-bit area coverage modulation+1-bit FRC driving, 7-gray scales are displayed.

First, the case of applying only the 2-bit area coverage modulation will be explained with reference to FIG. 7A. In the case of applying driving the 2-bit area coverage modulation, one screen is formed by one frame period. As shown in FIG. 7A, four gray scales are displayed in total, which are "0" indicating that three sub-pixels are all in a light-out state, "1" indicating that only the central sub-pixel is in a lighting state, "2" indicating that two sub-pixels above and below are in the lighting state and "3" indicating that three sub-pixels are all in the lighting state.

On the other hand, in the case of applying 2-bit area coverage modulation+1-bit FRC driving, one screen is formed by two-frame (sub-frame) period. Then, three gray scales of 0.5, 1.5 and 2.5 are added to the above four gray scales which are the same lighting driving in two frames as shown in FIG. 7B.

In the gray scale 0.5, three sub-pixels are all in the light-out state in the first frame and only the central sub-pixel is in the lighting state in the second frame. In the gray scale 1.5, only the central sub-pixel is in the lighting state in the first frame and two sub-pixels above and below are in the lighting state in the second frame. In the gray scale 2.5, two sub-pixels above and below are in the lighting state in the first frame and three sub-pixels are all in the lighting state in the second frame.

As apparent from the above, it is possible to increase the number of gray scales to be displayed for the bits of FRC driving by using both the area coverage modulation and the FRC driving. If the simple 3-bits pixel configuration is applied, the circuits for the pixels are packed into the pixel (sub-pixels) 20, therefore, the pixel size is increased unless wiring rules becomes high definition, which is disadvantageous for allowing the display device to be high definition.

When the pixel 20 has the configuration of the three-divided electrodes and is driven by the area coverage modulation in the pixel configuration in which the two sub-pixel electrodes $206_A$ and $206_B$ above and below sandwiching the sub-pixel electrode 205 are driven at the same time, it is possible to allow the center of the pixel in the gray scale display to correspond to the center of the display image (gray scale) between plural frames. Here, "correspond" includes not only a case in which the center of the pixel of gray scale display strictly corresponds to the center of the display image between plural frames but also a case in which they substantially correspond to each other. All sorts of variations occurring on design or on manufacture are allowable.

Then, fluctuation does not occur in the display image in the frame period as the center of the pixel corresponds to the center of the gray scale (display image) between frames (sub-frames), therefore, display characteristics can be further improved. Additionally, it is possible to delay the time of the frame period (frame rate) as fluctuation does not occur in the display image in the frame period, therefore, power consumption in the FRC driving can be reduced.

(2-bit Area Coverage Modulation+2-bit FRC Driving)

Next, the case of performing 2-bit FRC driving with respect to 2-bit area coverage modulation (area ratio=1:2) will be explained with reference to FIG. 8.

Figure 8:
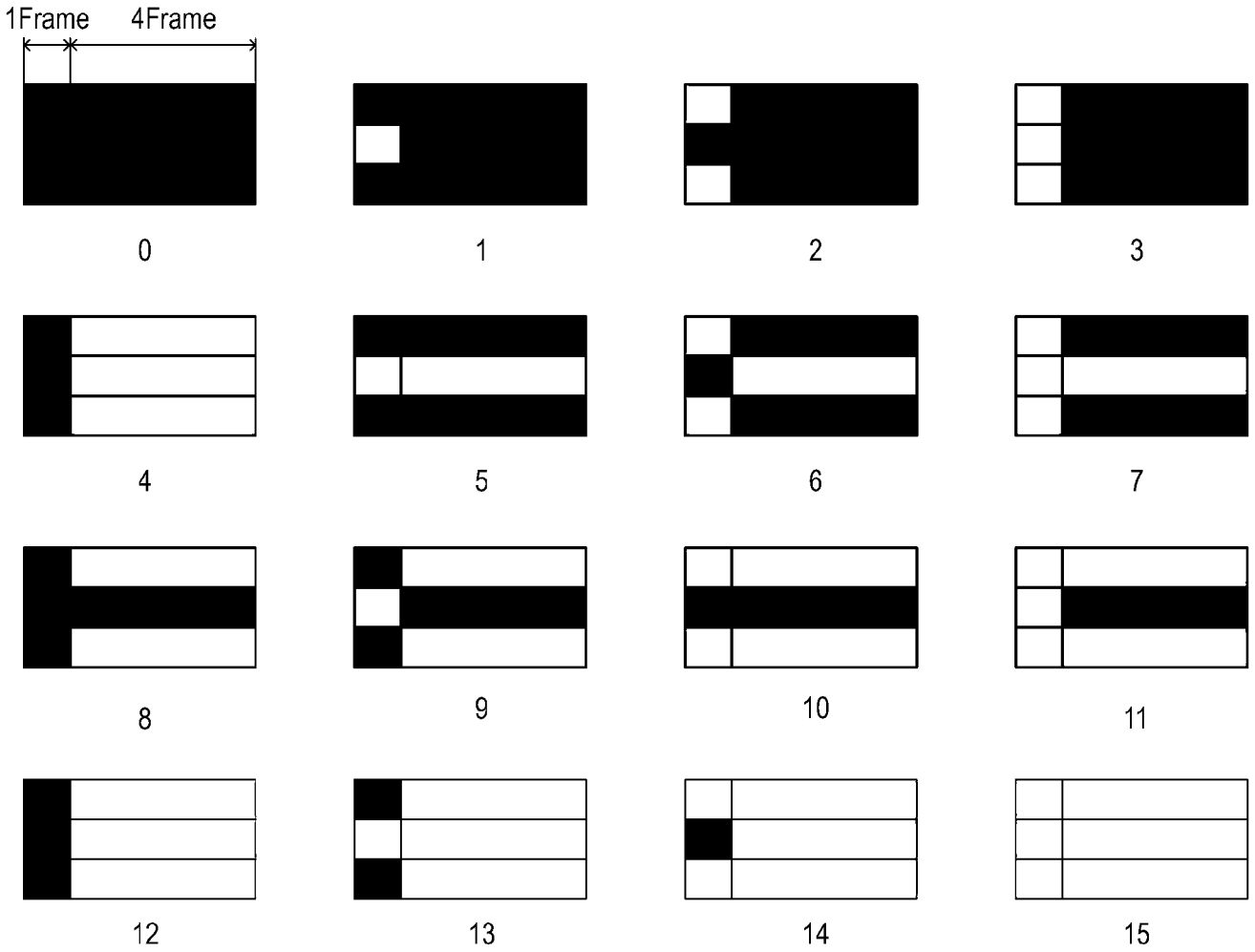
FIG. 8 is an explanatory diagram showing a case of 2-bit area coverage modulation+2-bit FRC driving.

As shown in FIG. 8, in the case of applying 2-bit area coverage modulation+2-bit FRC driving, time for expressing one gray scale (time necessary for gray scale expression) is divided as 1:4, gray scale expression of the total 4-bit (=16 gray scales) including spatial 2-bit and temporal 2-bit can be realized. Here, to divide time for expressing one gray scale as 1:4 means to express one gray scale in 5 frames (sub-frames).

As described above, 5 frames are necessary for gray scale expression in the case of 2-bit area coverage modulation+2-bit FRC driving, therefore, one gray scale is expressed by one frame, namely, driving is performed at five-times speed of the normal driving in which one frame is one cycle.

[2-4. Characteristics of Embodiment]

As described above, in the liquid crystal display device, response speed differs at the transition from the liquid crystal ON-state to the liquid crystal OFF-state and at the transition from the liquid crystal OFF-state to the liquid crystal ON-state under the characteristics of liquid crystal, therefore, it is difficult to display a desired halftone gray scale when applying the FRC driving.

Figure 9:
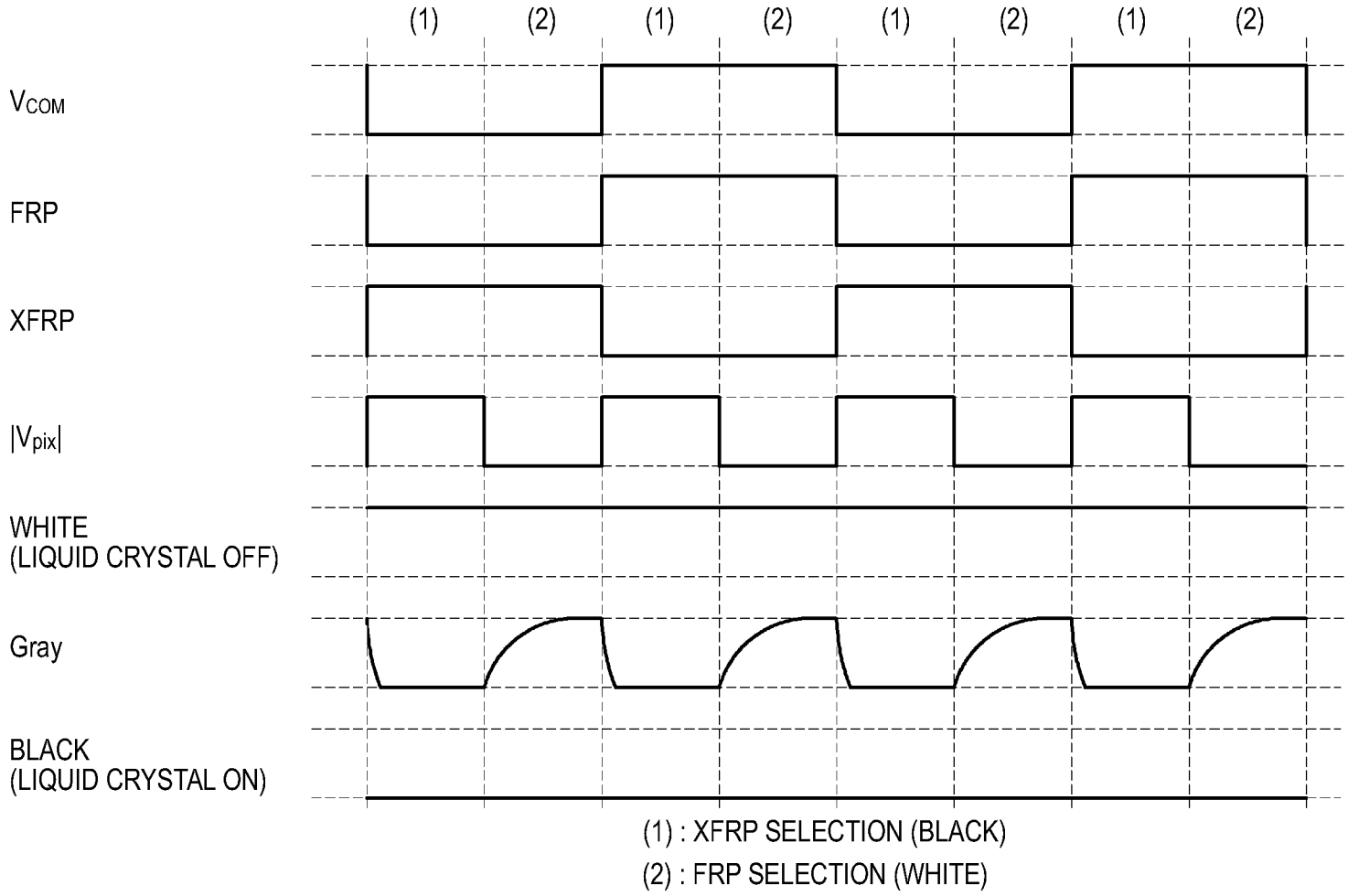
FIG. 9 is a timing waveform chart used for explaining problems at the time of FRC driving in a case of normally white liquid crystal.

The case of normally white liquid crystal will be explained as an example with reference to a timing waveform chart of FIG. 9. In FIG. 9, the common voltage $V_{COM}$, voltages FRP and XFRP having the same phase as, and the reverse phase to the common voltage $V_{COM}$, a voltage $|V_{pix}|$ to be applied to the liquid crystal capacitor 21 and luminance characteristics are shown. In FIG. 9, (1) and (2) represent sub-frames in the FRC driving. (1) represents a sub-frame of selecting (black) the voltage VFRP with the reverse phase and (2) represents a sub-frame selecting (white) of the voltage FRP with the same phase.

In the case of normally white liquid crystal, the response speed is faster at the transition from liquid crystal OFF (white) to liquid crystal ON (black) than in the case of the transition from liquid crystal ON to the liquid crystal OFF. That is, falling is relatively fast and rising is relatively slow in luminance characteristics of the halftone gray scale (gray) shown in FIG. 9. An integral value of luminance characteristics is visibly recognized by human eyes as gray scales. Therefore, when the response speed differs at the time of liquid crystal ON/OFF, the gray scale is recognized as gray close to black in the normally liquid crystal at the time of applying the FRC driving. That is, it is difficult to display a desirable halftone gray scale.

Figure 10:
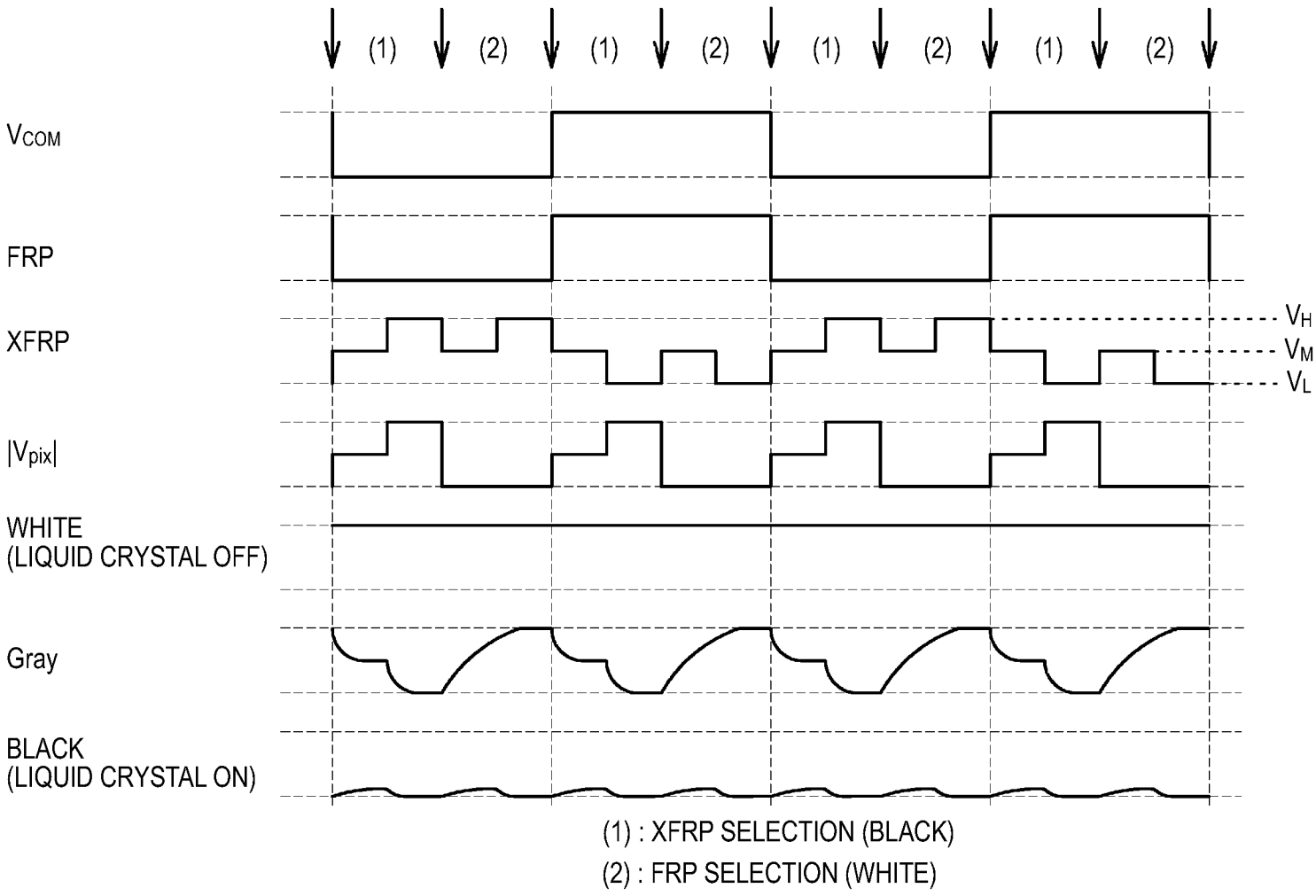
FIG. 10 is a timing waveform chart used for explaining operation at the time of FRC driving in the case of normally white liquid crystal when applying a driving method according to the embodiment (No. 1)

In response to the above, the voltage XFRP having the phase reverse to the common voltage $V_{COM}$ is switched to an intermediate voltage $V_M$ at the timing when the sub-frame (2) is switched to the sub-frame (1) (the timing shown by arrows in the drawing) as shown in a timing waveform chart of FIG. 10. Here, switching timing from the sub-frame (2) to the sub-frame (1), namely, the switching timing of FRC driving correspond to the timing when white display is switched to black display in the normally white liquid crystal, and also the timing of rewriting memory contents in the memory units of the pixels 20.

Accordingly, the intermediate voltage $V_M$ is interposed at the time of transition from the supply of the voltage FRP with the same phase to the supply of the voltage XFRP with the reverse phase, thereby supplying the intermediate voltage $V_M$ to the pixel electrodes in the present embodiment. The switching of voltage value to the voltage XFRP with the reverse phase is executed in the pixel drive unit 70 shown in FIG. 4.

As described above, the intermediate voltage $V_M$ is imposed (inserted) in the voltage XFRP having the phase reverse to the common voltage $V_{COM}$ at the transition from the liquid crystal ON (white) to the liquid crystal OFF (black) when applying the FRC driving, thereby delaying the response speed of liquid crystal (so-called under-drive) as shown in FIG. 10 (Gray).

The difference of response speed at the time of liquid crystal ON/OFF can be reduced as compared with the case of not interposing the intermediate voltage $V_M$ by delaying the response speed of liquid crystal at the transition from liquid crystal ON to liquid crystal OFF. Accordingly, as the phenomenon that the halftone gray scale becomes close to black can be avoided in the normally white liquid crystal, the display of a desirable halftone gray scale can be realized.

Though the intermediate voltage $V_M$ is interposed also at the time of displaying black, response speed from a second voltage $V_L$ corresponding to black display to the intermediate voltage $V_M$ is extremely slow, therefore, the misadjusted black level is low as shown in FIG. 10 (black), which will be no problem in visible recognition.

The switching timing of FRC driving correspond to the timing of rewriting memory contents in the pixels 20 as described above, which differ according to positions of the pixels 20. Accordingly, it is necessary to generate waveforms corresponding to switching timing of FRC driving, namely, waveforms corresponding to the timing of rewriting memory contents of the pixels 20 with respect to the voltage XFRP with the reverse phase to the common voltage $V_{COM}$. This will be specifically explained with reference to FIG. 12 and FIG. 13.

Figure 12:
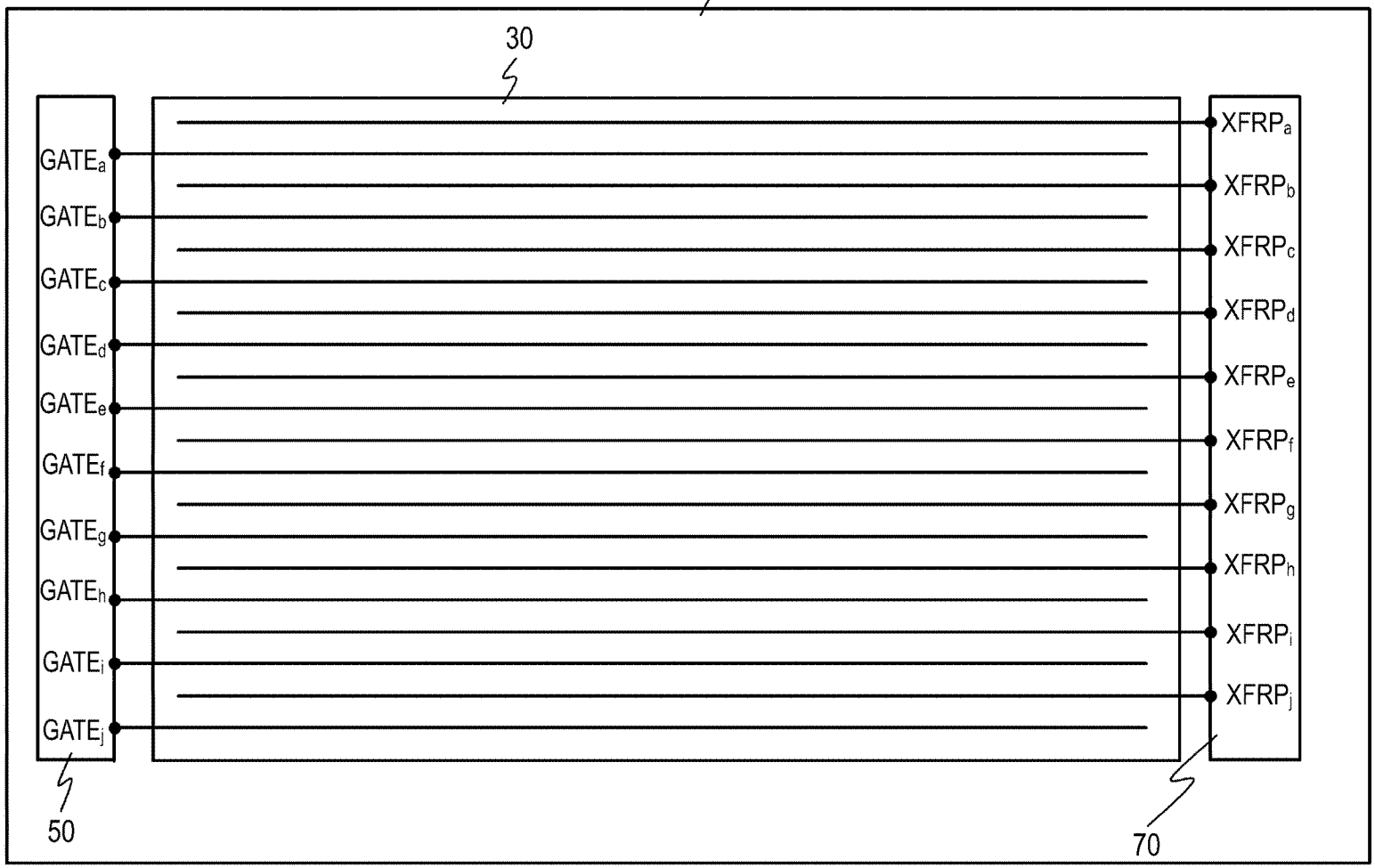
FIG. 12 is a block diagram showing the relation among a pixel array unit, a control line drive unit and a pixel drive unit on a liquid crystal display panel.

The relation among the pixel array unit 30, the control line drive unit 50 and the pixel drive unit 70 on the liquid crystal display panel 11 is shown in FIG. 12. Also as described above, the control line drive unit 50 controls writing operation of signal potentials reflecting gray scales with respect to the pixels 20 in units of lines (pixel rows). The pixel drive unit 70 supplies the voltages FRP and XFRP having the same phase as, and the reverse phase to the common voltage $V_{COM}$ in the units of lines.

In FIG. 12, the pixel array unit 30 is assumed to have 10 lines of "a" to "j" for simplifying the drawing. Then, scanning pulses $GATE_a$ to $GATE_j$ are supplied from the control line drive unit 50, and voltages $XFRP_a$ to $XFRP_j$ having the reverse phase to the common voltage $V_{COM}$ are supplied from the pixel drive unit 70 to respective lines "a" to "j" of the pixel array unit 30. Voltages having the same phase as the common voltage $V_{COM}$ are not shown here.

Figure 11:
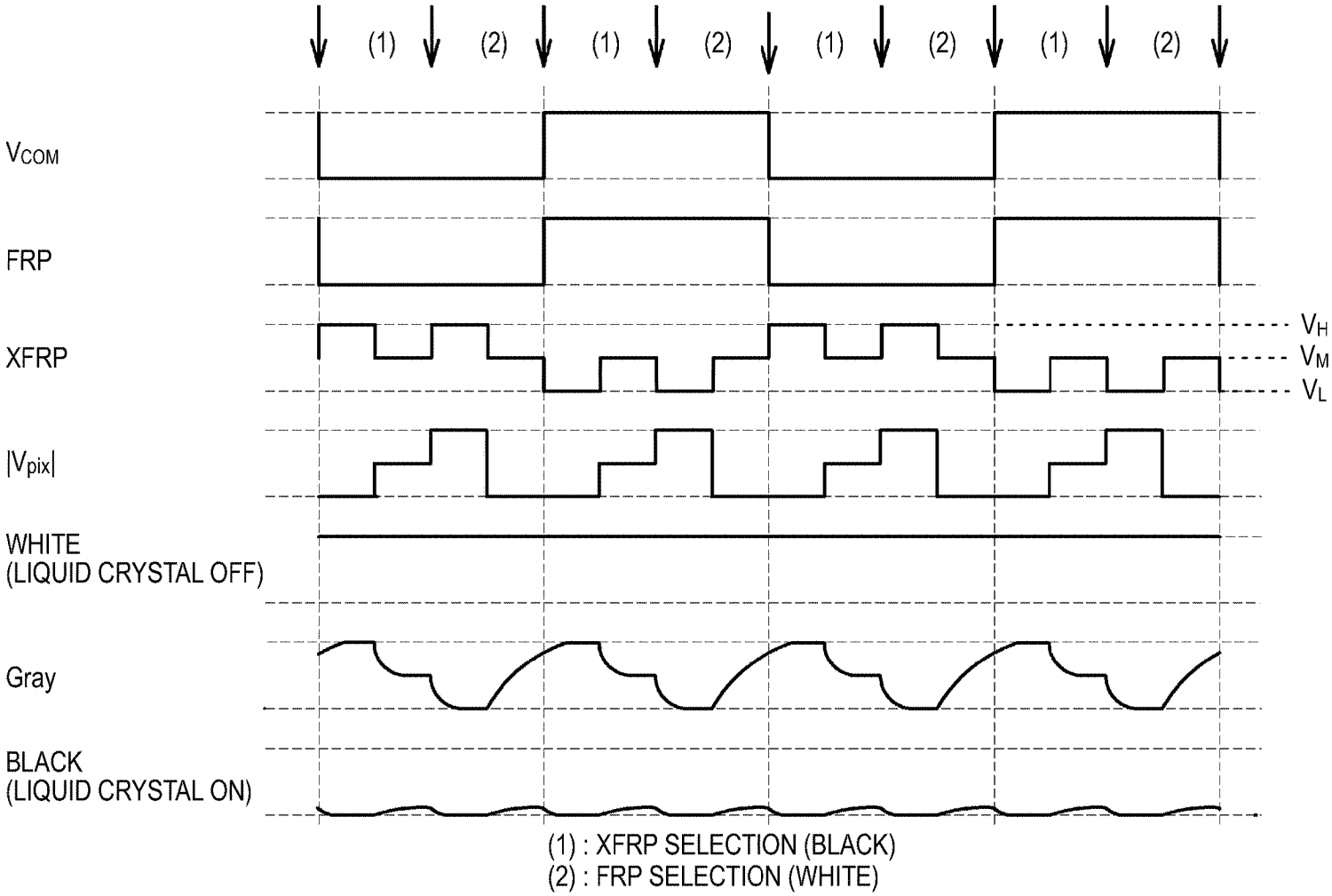
FIG. 11 is a timing waveform chart used for explaining operation at the time of FRC driving in the case of normally white liquid crystal when applying the driving method according to the embodiment (No. 2)
Figure 13:
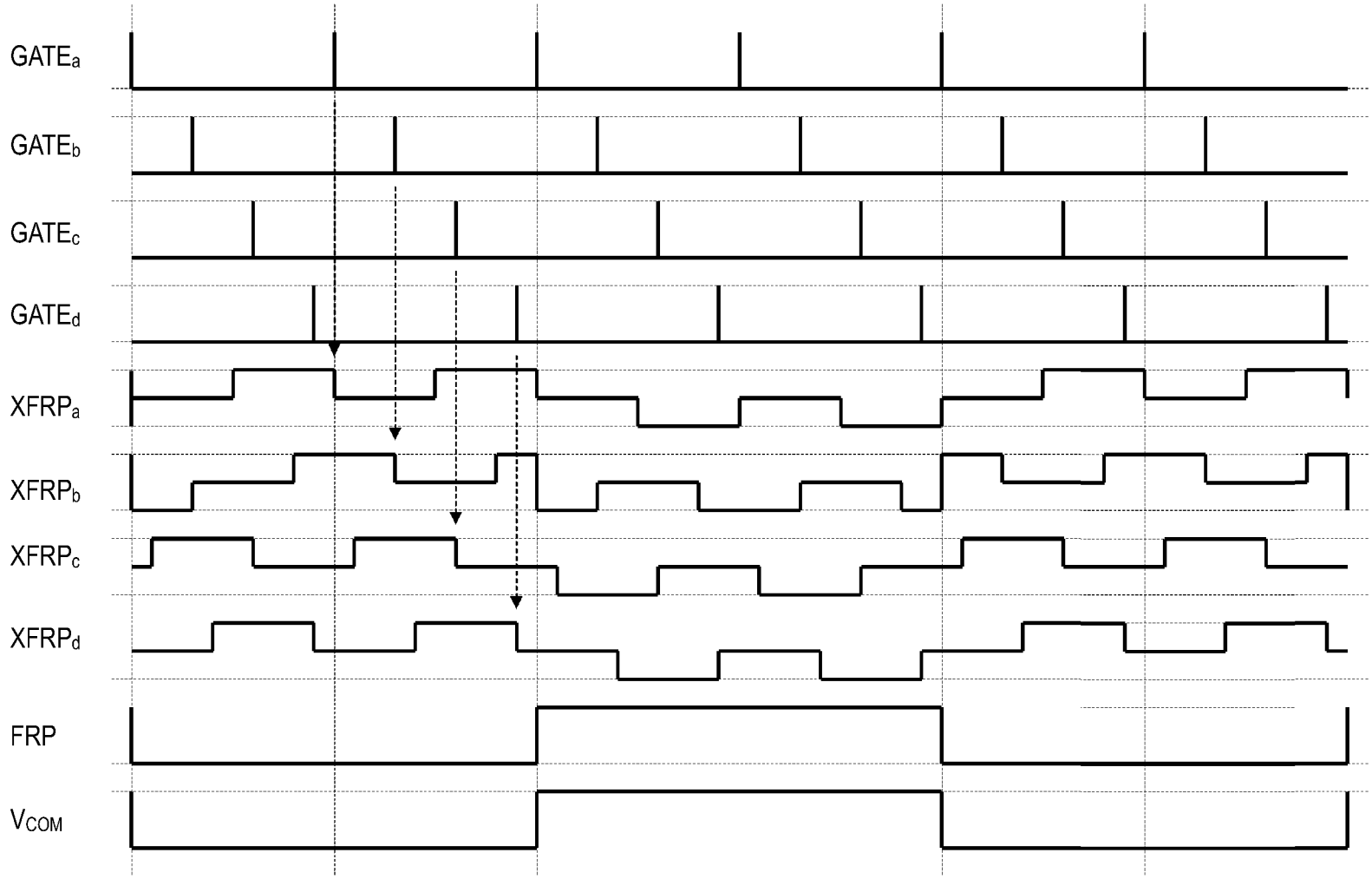
FIG. 13 is a timing waveform chart showing the timing relation among scanning pulses $GATE_a$ to $GATE_d$ for four lines, voltages $XFRP_a$ to $XFRP_d$ with the reverse phase, the voltage FRP with the same phase and a common voltage $V_{COM}$.

In FIG. 13, the timing relation among scanning pulses $GATE_a$ to $GATE_d$ for four lines, voltages $XFRP_a$ to $XFRP_d$ with the reverse phase, the voltage FRP with the same phase and the common voltage $V_{COM}$ is shown in FIG. 13. In a timing waveform chart of FIG. 13, the timing when the scanning pulses $GATE_a$ to $GATE_d$ become active (rise) corresponds to the switching timing of FRC driving (the timing shown by arrows) in FIG. 10 and FIG. 11.

As shown in FIG. 13, the intermediate voltage $V_M$ is supplied in synchronization with the timing of rewriting memory contents of the pixels 20 with respect to the voltage XFRP having the phase reverse to the common voltage $V_{COM}$, thereby positively obtaining operations and effects generated by interposing (inserting) the intermediate voltage $V_M$ at the time of transition from liquid crystal ON (white) to liquid crystal OFF (black).

Here, when the waveforms of the voltage XFRP having the phase reverse to the common voltage $V_{COM}$ are made to correspond to waveforms of the FRC switching timing, the timing of supplying the intermediate voltage $V_M$ is controlled so as to correspond to lines to which display driving is performed by the control line drive unit 50.

Additionally, it is preferable to apply a configuration in which the supply of the intermediate voltage $V_M$ is controlled according to the temperature of peripheral environment of the liquid crystal display panel 11 when the intermediate voltage $V_M$ is interposed in the voltage XFRP having the phase reverse to the common voltage $V_{COM}$ at the time of transition from liquid crystal ON to liquid crystal OFF. Because the response characteristics of liquid crystal vary according to the temperature of peripheral environment of the liquid crystal display device (liquid crystal display panel) as described above.

Figure 14:
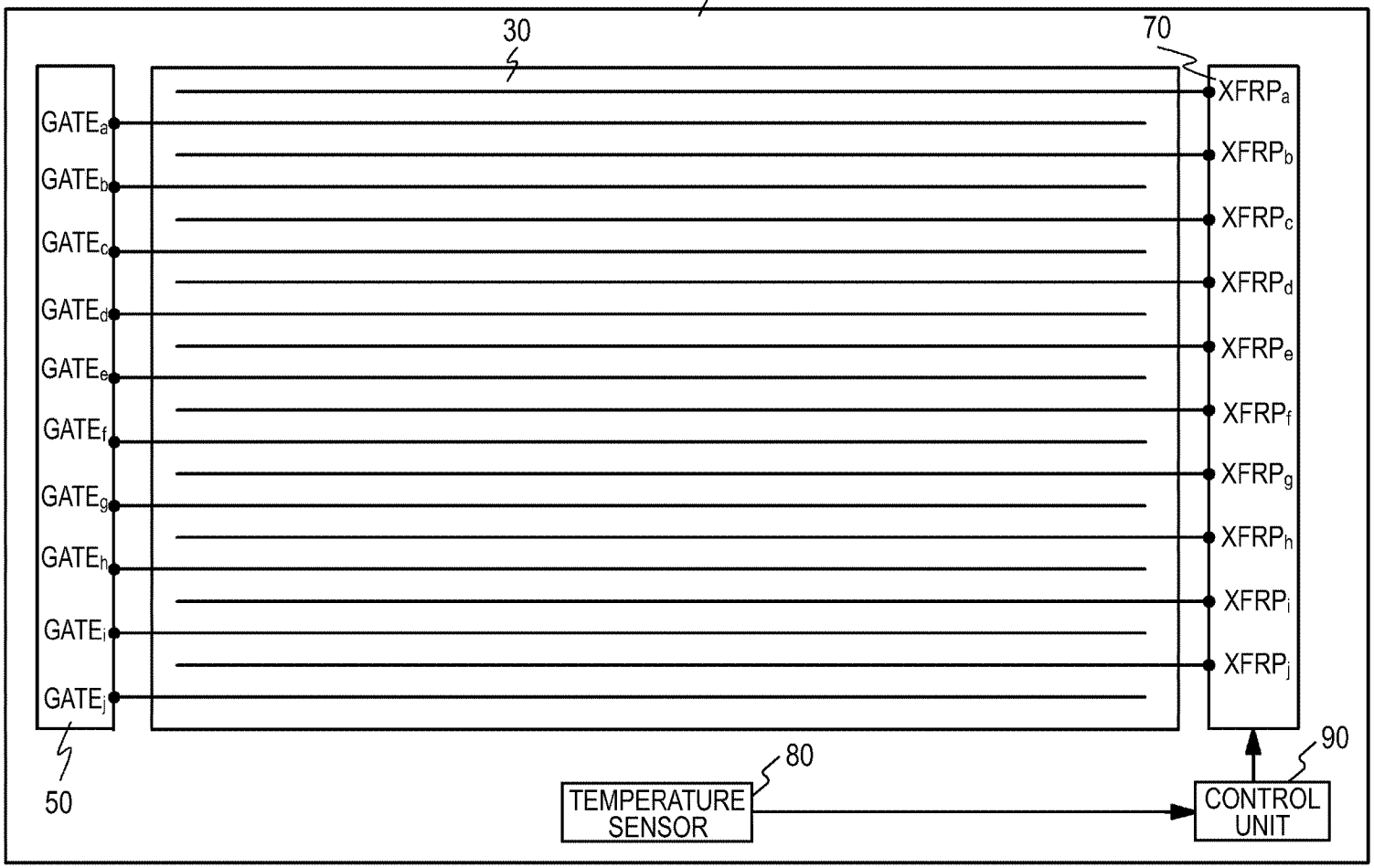
FIG. 14 is a block diagram showing a configuration example of a control system for controlling supply of an intermediate voltage $V_M$ under a normal environment.

Specifically, a temperature sensor 80 is disposed on, or in the vicinity of the liquid crystal display panel 11 as shown in FIG. 14. Then, the voltage XFRP having the phase reverse to the common voltage $V_{COM}$ outputted from the pixel drive unit 70, more specifically, the supply of the intermediate voltage $V_M$ is controlled under the control by the control unit 90 based on the temperature of peripheral environment detected (measured) by the temperature sensor 80.

The response characteristics of liquid crystal become faster under the environment in a high-temperature state in which the temperature of peripheral environment exceeds a given temperature (for example, approximately 70 degrees). Accordingly, the response speed of liquid crystal at the time of transition of liquid crystal ON to liquid crystal OFF also becomes high in, for example, the normally white liquid crystal. At this time, there is a worry that the misadjusted black level becomes prominent while the intermediate voltage $V_M$ remains unchanged.

Accordingly, the intermediate voltage $V_M$ is not supplied when the temperature of peripheral environment exceeds the given temperature and the intermediate voltage $V_M$ is supplied when the temperature of peripheral environment is equal to or lower than the given temperature, thereby performing control not affected by the temperature of peripheral environment, that is, performing control in which the misadjusted black level can be suppressed.

Specific examples of controlling the supply of the intermediate voltage $V_M$ under the normal environment in which the temperature is equal to or lower than the given temperature will be explained below.

EXAMPLE 1

Figure 15:
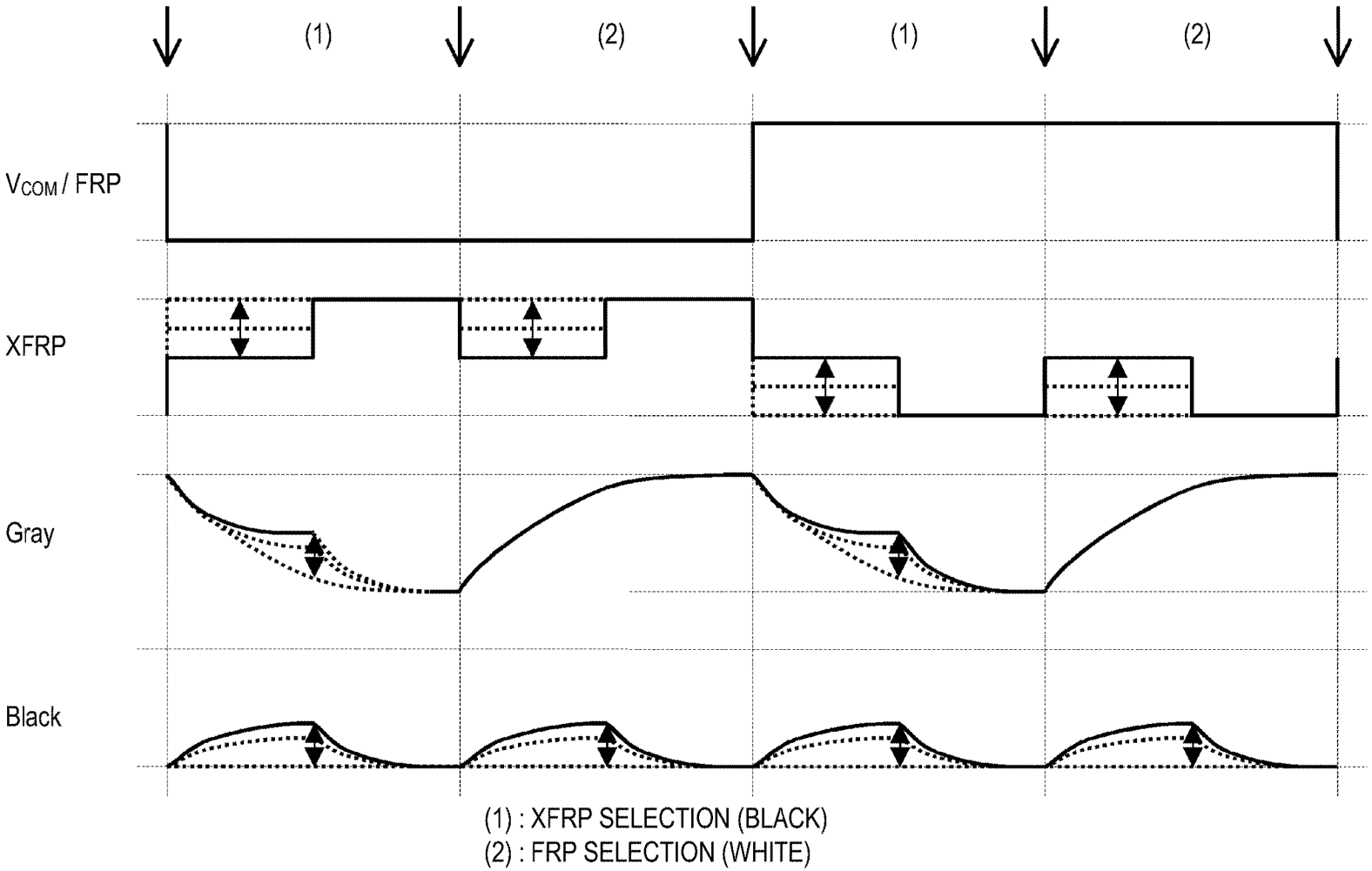
FIG. 15 is a timing waveform chart used for explaining an example 1 in which the supply of the intermediate voltage $V_M$ is controlled under the normal environment.

FIG. 15 is a timing waveform chart for explaining an example 1 in which the supply of the intermediate voltage $V_M$ is controlled under the normal environment.

In the example 1, a voltage value of the intermediate voltage $V_M$ is adjusted in accordance with a detected temperature of the temperature sensor 80 when the temperature of peripheral environment is equal to or lower than the given temperature, that is, measurement results of the temperature sensor 80 are fed back to the voltage value of the intermediate voltage $V_M$. At this time, the voltage value of the intermediate voltage $V_M$ may be adjusted in stages in accordance with the detected temperature of the temperature sensor 80 or may be continuously adjusted. These adjustments are executed under control by the control unit 90.

EXAMPLE 2

Figure 16:
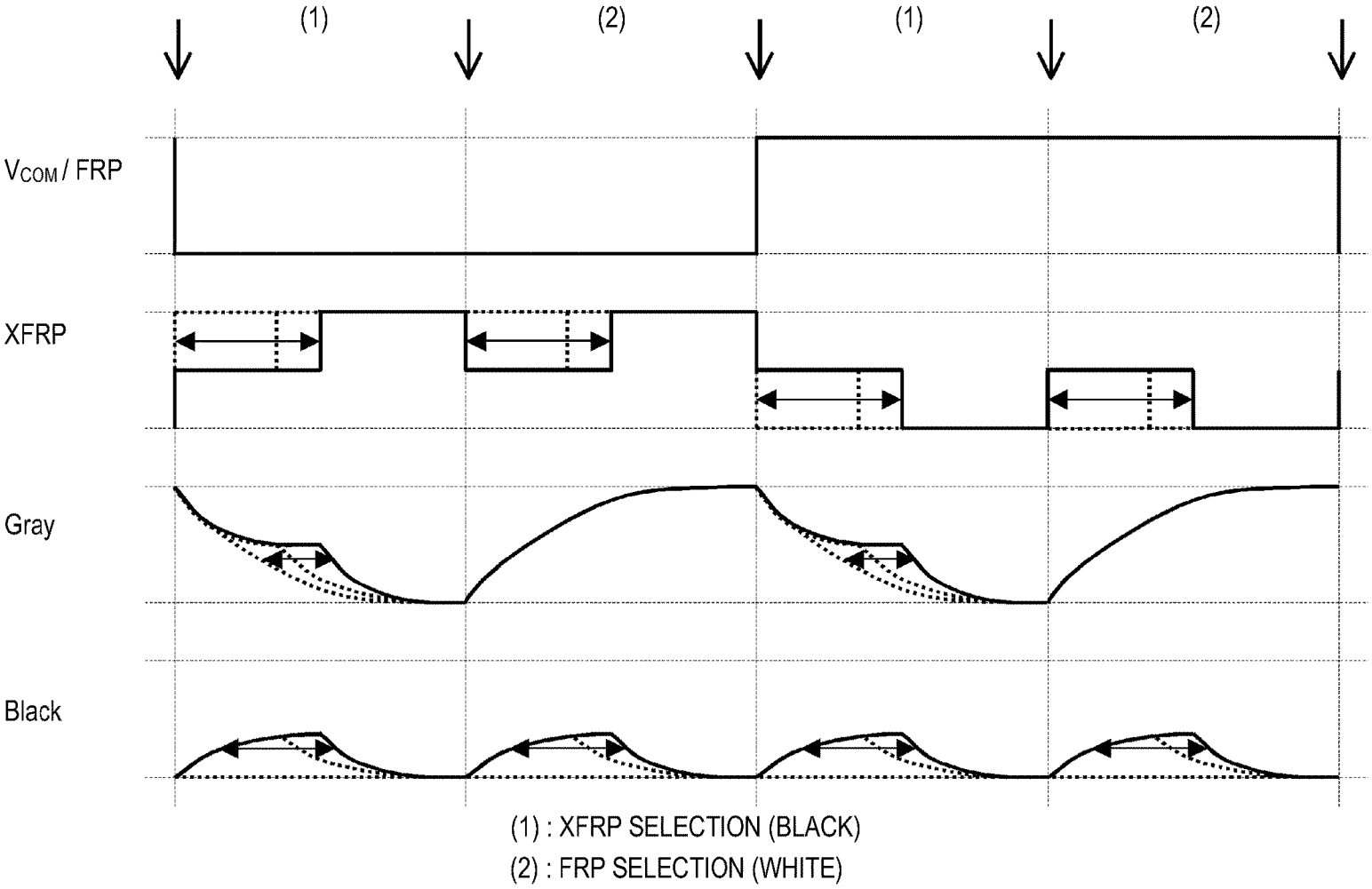
FIG. 16 is a timing waveform chart used for explaining an example 2 in which the supply of the intermediate voltage $V_M$ is controlled under a high-temperature environment.

FIG. 16 is a timing waveform chart for explaining an example 2 in which the supply of the intermediate voltage $V_M$ is controlled under the normal environment.

In the example 2, a period (pulse width) of supplying the intermediate voltage $V_M$ is adjusted in accordance with the detected temperature of the temperature sensor 80 when the temperature of peripheral environment is equal to or lower than the given temperature, that is, measurement results of the temperature sensor 80 are fed back to the period of supplying the intermediate voltage $V_M$. At this time, the voltage value of the intermediate voltage $V_M$ may be adjusted in stages in accordance with the detected temperature of the temperature sensor 80 or may be continuously adjusted. These adjustments are executed under control by the control unit 90.

<3. Electronic Apparatus>

The above-explained liquid crystal display device according to the embodiment of the present disclosure can be used as a display unit (display device) of electronic apparatuses of various fields which display a video signal inputted to the electronic apparatus or a video signal generated in the electronic apparatus as an image or video.

As apparent from the explanation of the above embodiment, the liquid crystal display device according to the embodiment of the present disclosure is characterized in that a desirable halftone gray scale can be displayed when applying the FRC driving. Therefore, the desirable halftone gray scale can be displayed while realizing image display having the large number of display gray scales by the FRC driving by using the liquid crystal display device according to the embodiment of the present disclosure as the display unit of the electronic apparatuses in various fields.

As electronic apparatus using the liquid crystal display device according to the embodiment of the present disclosure as the display unit, for example, a digital camera, a video camera, game machines, a notebook personal computer and so on can be cited as examples. In particular, the liquid crystal display device according to the embodiment of the present disclosure is preferably used in electronic apparatuses which are, for example, portable information devices such as an electronic book device, an electronic watch and portable communication devices such as a cellular phone device and a PDA (Personal Digital Assistant).

<4. Configuration of Present Disclosure>

The present disclosure may be implemented as the following configurations.

(1) A liquid crystal display device in which pixels having a memory function are arranged, including a display drive unit performing display driving by a driving method for obtaining halftone gray scales by setting plural frames as one cycle and temporarily changing gray scales of respective pixels within one cycle, and a pixel drive unit supplying a voltage having the same phase as, or a voltage having a reverse phase to a common voltage the polarity of which is inverted in a given cycle and applied to counter electrodes of liquid crystal capacitors to pixel electrodes of the liquid crystal capacitors, in which the pixel drive unit supplies an intermediate voltage between a high-voltage side and a low-voltage side of the common voltage to the pixel electrodes of the liquid crystal capacitors at the time of transition from the supply of the voltage having the same phase to the supply of the voltage having reverse phase.

(2) The liquid crystal display device descried in the above (1), in which the pixel drive unit controls the timing of supplying the intermediate voltage so as to correspond to lines to which display driving is performed.

(3) The liquid crystal display device descried in the above (2), in which the pixel drive unit supplies the intermediate voltage in accordance with the timing of rewriting memory contents of the pixels.

(4) The liquid crystal display device descried in the above any one of (1) to (3), in which the pixel drive unit controls the supply of the intermediate voltage in accordance with the temperature of peripheral environment.

(5) The liquid crystal display device descried in the above (4), in which the pixel drive unit supplies the intermediate voltage when the temperature of peripheral environment is equal to or lower than a given temperature.

(6) The liquid crystal display device descried in the above (5), in which the pixel drive unit adjusts a voltage value of the intermediate voltage in accordance with the temperature of peripheral environment.

(7) The liquid crystal display device descried in the above (1), in which the pixel drive unit adjusts a period of supplying the intermediate voltage in accordance with the temperature of peripheral environment.

(8) A drive method to be used when driving a liquid crystal display device in which pixels having a memory function are arranged and which includes a display drive unit performing display driving by a driving method for obtaining halftone gray scales by setting plural frames as one cycle and temporarily changing gray scales of respective pixels within one cycle, in which a voltage having the same phase as, or a voltage having a reverse phase to a common voltage the polarity of which is inverted in a given cycle and applied to counter electrodes of liquid crystal capacitors is supplied to pixel electrodes of the liquid crystal capacitors, the method including supplying an intermediate voltage between a high-voltage side and a low-voltage side of the common voltage to the pixel electrodes of the liquid crystal capacitors at the time of transition from supply of the voltage of the same phase to the supply of the voltage having reverse phase.

(9) An electronic apparatus including a liquid crystal display device in which pixels having a memory function are arranged and which includes a display drive unit performing display driving by a driving method for obtaining halftone gray scales by setting plural frames as one cycle and temporarily changing gray scales of respective pixels within one cycle, and a pixel drive unit supplying a voltage having the same phase as, or a voltage having a reverse phase to a common voltage the polarity of which is inverted in a given cycle and applied to counter electrodes of liquid crystal capacitors to pixel electrodes of the liquid crystal capacitors, in which the pixel drive unit supplies an intermediate voltage between a high-voltage side and a low-voltage side of the common voltage to the pixel electrodes of the liquid crystal capacitors at the time of transition from the supply of the voltage having the same phase to the supply of the voltage having reverse phase.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A liquid crystal display device in which pixels having a memory function are arranged, comprising:

pixel electrodes constituting the pixels arranged in a matrix;

counter electrodes disposed opposed to the pixel electrodes, liquid crystal capacitors of the pixel being formed between the pixel electrodes and the counter electrodes;

a display drive unit configured to perform display driving by a driving method for obtaining halftone gray scales by setting frames as one cycle and temporarily changing gray scales of respective pixels within one cycle; and a pixel drive circuit configured to supply a first signal and a second signal that is different from the first signal to each of the pixel electrodes, the first signal being switched to the second signal or the second signal being switched to the first signal by each of the frames, at a switching timing, wherein the counter electrodes are applied with a common voltage signal of which a polarity is inverted in a polarity cycle of a polarity cycle period;

wherein the first signal has, in all of the polarity cycle periods, a same phase with the common voltage signal;

wherein the second signal has, in a first-second voltage period of the polarity cycle period, one of a first voltage and a second voltage, each of which is a voltage of a reverse phase to the common voltage signal, and in a third voltage period of the polarity cycle period, a third voltage that is between the first voltage and the second voltage, the first-second voltage period and the third voltage period are alternately repeated; and wherein the switching timing is when the second signal is switched from the first voltage or the second voltage to the third voltage.

2. The liquid crystal display device according to claim 1, wherein the pixel drive circuit controls the timing of switching the second signal from the first voltage or the second voltage to the third voltage so as to correspond to lines to which display driving is performed by the display drive unit.

3. The liquid crystal display device according to claim 2, wherein the pixel drive circuit switches the second signal from the first voltage or the second voltage to the third voltage in accordance with the timing of rewriting memory contents of the pixels.

4. The liquid crystal display device according to claim 1, wherein the pixel drive circuit controls the second signal in accordance with an ambient temperature.

5. The liquid crystal display device according to claim 4, wherein the pixel drive circuit controls, when the ambient temperature is higher than a predetermined temperature, the third voltage to have a voltage of one of the first voltage and the second voltage that has the reverse phase to the common voltage signal.

6. The liquid crystal display device according to claim 5, wherein the pixel drive circuit adjusts a value of the third voltage in accordance with the ambient temperature.

7. The liquid crystal display device according to claim 5, wherein the pixel drive circuit adjusts a period of supplying the third voltage in accordance with the ambient temperature.

8. A drive method to be used when driving a liquid crystal display device in which pixels having a memory function are arranged and which includes:

pixel electrodes constituting the pixels arranged in a matrix; and counter electrodes disposed opposed to the pixel electrodes, liquid crystal capacitors of the pixel being formed between the pixel electrodes and the counter electrodes, the drive method comprising:

performing display driving by a driving method for obtaining halftone gray scales by setting frames as one cycle and temporarily changing gray scales of respective pixels within one cycle, by a display drive unit;

supplying a first signal and a second signal that is different from the first signal, by a pixel drive circuit to each of the pixel electrodes, the first signal being switched to the second signal or the second signal being switched to the first signal by each of the frames, at a switching timing; and applying a common voltage signal of which a polarity is inverted in a polarity cycle of a polarity cycle period, to the counter electrodes, wherein the first signal has, in all of the polarity cycle periods, a same phase with the common voltage signal; and wherein the second signal has, in a first-second voltage period of the polarity cycle period, one of a first voltage and a second voltage, each of which is a voltage of a reverse phase to the common voltage signal, and in a third voltage period of the polarity cycle period a third voltage between the first voltage and the second voltage, the first-second voltage period and the third voltage period are alternately repeated; and wherein the switching timing is when the second signal is switched from the first voltage or the second voltage to the third voltage.

9. An electronic apparatus including a liquid crystal display device in which pixels having a memory function are arranged and which comprises:

pixel electrodes constituting the pixels arranged in a matrix;

counter electrodes disposed opposed to the pixel electrodes, liquid crystal capacitors of the pixel being formed between the pixel electrodes and the counter electrodes;

a display drive unit configured to perform display driving by a driving method for obtaining halftone gray scales by setting frames as one cycle and temporarily changing gray scales of respective pixels within one cycle; and a pixel drive circuit configured to supply a first signal and a second signal that is different from the first signal to each of the pixel electrodes, the first signal being switched to the second signal or the second signal being switched to the first signal by each of the frames, at a switching timing, wherein the counter electrodes are applied with a common voltage signal of which a polarity is inverted in a polarity cycle of a polarity cycle period;

wherein the first signal has, in all of the polarity cycle periods, a same phase with the common voltage signal;

wherein the second signal has, in a first-second voltage period of the polarity cycle period, one of a first voltage and a second voltage, each of which is a voltage of a reverse phase to the common voltage signal, and in a third voltage period of the polarity cycle period, a third voltage that is between the first voltage and the second voltage, the first-second voltage period and the third voltage period are alternately repeated; and wherein the switching timing is when the second signal is switched from the first voltage or the second voltage to the third voltage.

* * * * *